US011607603B2

(12) United States Patent
Govoni et al.

(10) Patent No.: US 11,607,603 B2
(45) Date of Patent: Mar. 21, 2023

(54) BOWLING CENTER BUMPER LIGHTING UNITS AND OPTICAL SENSORS

(71) Applicant: QUBICAAMF EUROPE S.P.A., Bologna (IT)

(72) Inventors: Emanuele Govoni, San Giovanni In Persiceto (IT); Roberto Vaioli, Ozzano Dell'Emilia (IT); Gian Luca Ferrari, Anzola Dell'Emilia (IT); Massimo Baraldi, Bologna (IT); Vittorio Scagliarini, Sant'Agata Bolognese (IT); Tommaso Parisi, Bologna (IT)

(73) Assignee: QUBICAAMF EUROPE S.P.A., Bologna (IT)

( * ) Notice: Subject to any disclaimer, the term of this patent is extended or adjusted under 35 U.S.C. 154(b) by 0 days.

(21) Appl. No.: 16/627,619

(22) PCT Filed: Jul. 11, 2018

(86) PCT No.: PCT/IB2018/055105
§ 371 (c)(1),
(2) Date: Dec. 30, 2019

(87) PCT Pub. No.: WO2019/012442
PCT Pub. Date: Jan. 17, 2019

(65) Prior Publication Data

US 2020/0139222 A1 May 7, 2020

(30) Foreign Application Priority Data

Jul. 12, 2017 (IT) ..... 102017000078353

(51) Int. Cl.
*A63D 5/04* (2006.01)

(52) U.S. Cl.
CPC ..... *A63D 5/04* (2013.01); *A63D 2005/042* (2013.01); *A63D 2005/044* (2013.01)

(58) Field of Classification Search
CPC ..... A63D 5/04; A63D 2005/042; A63D 2005/044
See application file for complete search history.

(56) References Cited

U.S. PATENT DOCUMENTS 2,316,991 A * 4/1943 Seaman ..... A63D 5/04 473/67
2,931,656 A * 4/1960 Hooker ..... A63F 7/0058 273/118 A (Continued)

FOREIGN PATENT DOCUMENTS

EP 0652797 5/1995
EP 1513595 3/2005

OTHER PUBLICATIONS

Qubica AMF, Hyper Bowling, HyperBump, https://www.qubicaamf.com/bowling-products/scoring-management-systems/hyperbowling/technology, Jun. 2020.*

(Continued)

*Primary Examiner* — William M Pierce
(74) *Attorney, Agent, or Firm* — Andrew M. Calderon; Calderon Safran & Cole, P.C.

(57) ABSTRACT

A bowling centre includes at least one bowling lane along which the bowl is rolled and having a rolling surface at one end of which are positioned the pins to be knocked down and at the opposite, longitudinal end of which is located the bowler's bay from where the bowl is thrown, the at least one lane including a side bumper running along each side of the lane and movable between a lowered position which allows the bowl to roll freely off the lane into a gutter which channels the bowl out of the lane, and a raised position for keeping the bowl on the bowling lane; an electronic control system configured to manage the at least one lane to implement a scoring program which calculates the score of the game played on the at least one lane; a lighting system (Continued)

includes a plurality of lighting units mounted on each side bumper, the lighting system being connected to the electronic control system which is configured to individually control each lighting unit in such a way as to light respective zones of each bumper in a differentiated manner.

35 Claims, 21 Drawing Sheets

(56) References Cited

U.S. PATENT DOCUMENTS 3,082,000 A * 3/1963 Holcombe ..... A63D 5/00 473/58
3,145,025 A * 8/1964 Morrison ..... A63D 5/04 473/67
3,252,705 A * 5/1966 Sol Cornberg ..... A63D 5/04 473/58
4,247,100 A * 1/1981 Barbee ..... A63D 5/04 473/58
4,893,182 A * 1/1990 Gautraud ..... G01S 3/7865 348/579
5,071,127 A * 12/1991 Bromley ..... A63F 7/0005 273/108.1
5,118,105 A * 6/1992 Brim ..... A63D 5/04 473/54
5,241,379 A * 8/1993 Tsujita ..... H04N 7/183 340/323 B
5,449,236 A * 9/1995 Hori ..... F16C 32/0659 384/118
5,449,326 A * 9/1995 File ..... A63D 1/00 473/113
5,584,766 A 12/1996 File
5,599,236 A 2/1997 File
5,626,523 A * 5/1997 Mowers ..... A63D 1/00 340/323 B
5,800,274 A * 9/1998 Widrick ..... A63D 5/00 473/113
5,846,138 A * 12/1998 Borden ..... A63D 1/00 473/54
5,882,263 A * 3/1999 Chung ..... A63D 5/04 473/70
5,888,142 A * 3/1999 Perrier ..... A63C 19/00 473/54
6,031,343 A * 2/2000 Recknagel ..... A63D 1/08 315/292
6,077,167 A * 6/2000 Ciniello ..... A63D 5/04 473/54
6,110,052 A * 8/2000 Sprager ..... A63D 5/04 340/323 B
6,319,142 B1 * 11/2001 Ciniello ..... A63D 5/04 473/54
7,025,687 B2 * 4/2006 Bouchard ..... A63D 5/04 473/115
7,708,647 B2 * 5/2010 Connell ..... A63D 5/00 473/54
8,088,017 B2 * 1/2012 Stremmel ..... A63D 5/04 473/58
8,292,733 B2 * 10/2012 Crawford ..... A63D 15/20 463/31
2002/0047646 A1 * 4/2002 Lys ..... F21S 4/28 315/312
2004/0242292 A1 12/2004 Hansen
2005/0014570 A1 * 1/2005 Blackstone ..... A63D 5/04 473/58
2005/0037853 A1 * 2/2005 Brim ..... B32B 27/36 473/115
2005/0063194 A1 * 3/2005 Lys ..... B60Q 3/85 362/489
2005/0096142 A1 * 5/2005 Saunier ..... A63D 1/00 473/115
2005/0288116 A1 * 12/2005 Chen ..... A63D 5/00 473/113
2005/0288117 A1 * 12/2005 Chen ..... A63D 1/08 473/113
2006/0022214 A1 * 2/2006 Morgan ..... H05B 45/22 257/99
2007/0184908 A1 * 8/2007 Hansen ..... A63D 5/04 463/49
2008/0287204 A1 * 11/2008 Stremmel ..... A63D 5/04 473/54
2009/0270193 A1 * 10/2009 Stremmel ..... A63B 69/0046 73/865.4
2011/0053688 A1 * 3/2011 Crawford ..... A63D 5/04 463/31
2011/0301726 A1 * 12/2011 Colquitt, Sr. ..... A63D 5/04 700/91
2013/0237334 A1 9/2013 Meigs
2013/0324272 A1 * 12/2013 Vaioli ..... A63D 5/04 473/70
2015/0367227 A1 * 12/2015 Vaioli ..... H05B 47/155 345/619

OTHER PUBLICATIONS

Crunchy Tech, Unreal Bowling, https://crunchytech.com/products/unreal-bowling/, Jan. 2022.*
International Search Report in related International Application No. PCT/IB2018/055105 dated Jan. 17, 2019, 3 pages.
Written Opinion in related International Application No. PCT/IB2018/055105 dated Jan. 17, 2019, 5 pages.

* cited by examiner

BOWLING CENTER BUMPER LIGHTING UNITS AND OPTICAL SENSORS

TECHNICAL FIELD

This invention relates to a bowling centre.

BACKGROUND ART

Known in the prior art are bowling centres which comprise one or more bowling lanes, at one end of which are positioned the pins to be knocked down and at the opposite, longitudinal end of which is located the bowl throwing zone. The lanes also comprise side bumpers which are movable between a lowered position which allows the bowl to roll freely off the lane into a gutter which collects the bowls that roll off the lanes, and a raised position for keeping the bowls on the lanes.

Bowling is a very popular game played by millions of people the world over. New technology makes playing easier and allows players to better enjoy the pleasure of a fun experience. For example, technology has allowed the introduction of scoring systems which automatically keep track of game scores so that players enjoy the game without the tediousness of this boring task.

Nowadays, modern bowling centres have electronic control systems configured to manage the bowling centre and to implement the scoring program which displays scores on screens where players can view them.

Lighting systems have also become a common feature of bowling centres.

The game of bowling has not changed much over the last 50 years. The basic format of the physical game has remained unchanged for years, and the only variations adopted have involved the game format, scoring calculation rules and game duration.

AIM OF THE INVENTION

The only relevant real functional innovation on how the game equipment is structured to increase the appeal of the game is mini-bowling. In mini-bowling, a scaled-down bowling lane not requiring dedicated shoes and installable outside a dedicated building allows more people to bowl in a non-competitive environment.

More specifically, in current bowling games, the presence of bumpers serves solely to prevent the bowl from falling into the gutter; in other words, at present, the purpose of a bumper is to keep the bowl on the lane, increasing the probability of its knocking down the pins, so as not to dampen the spirits of novice players. The bumpers can be activated temporarily in a lane (lifted manually or automatically) so that a bowler can decide to bowl with or without them.

Provided according to this disclosure is a bowling centre comprising one or more bowling lanes along which the bowl is rolled, at one end of which are positioned the pins to be knocked down and at the opposite, longitudinal end of which is located the bowl throwing zone, and which in particular, are provided with side bumpers which are preferably movable between a lowered position which allows the bowl to roll freely off the lane into a gutter which collects the bowls that roll off the lane, and a raised position for keeping the bowl on the bowling lane, the bowling centre also comprising an electronic control system which is configured to manage the bowling centre and which, in particular, implements the program which calculates the score of the game being played on the respective lane, and a lighting system; characterized in that the lighting system comprises a plurality of lighting units and in that the electronic control system of the bowling centre controls each lighting unit individually, that is, independently of the others.

That way, special light effects can be created at each lane or in the bowling centre as a whole in order to underline an event or sequence of events which have already occurred or an action or sequence of actions to be taken by players.

BRIEF DESCRIPTION OF THE DRAWINGS

These and other innovative aspects, or specific advantageous embodiments are set out in the appended claims and the technical features of the invention are apparent from the detailed description which follows of a preferred advantageous embodiment of it, to be considered purely as a non-limiting example, with reference to the accompanying drawings, in which:

DETAILED DESCRIPTION OF PREFERRED EMBODIMENTS OF THE INVENTION

Figure 1:
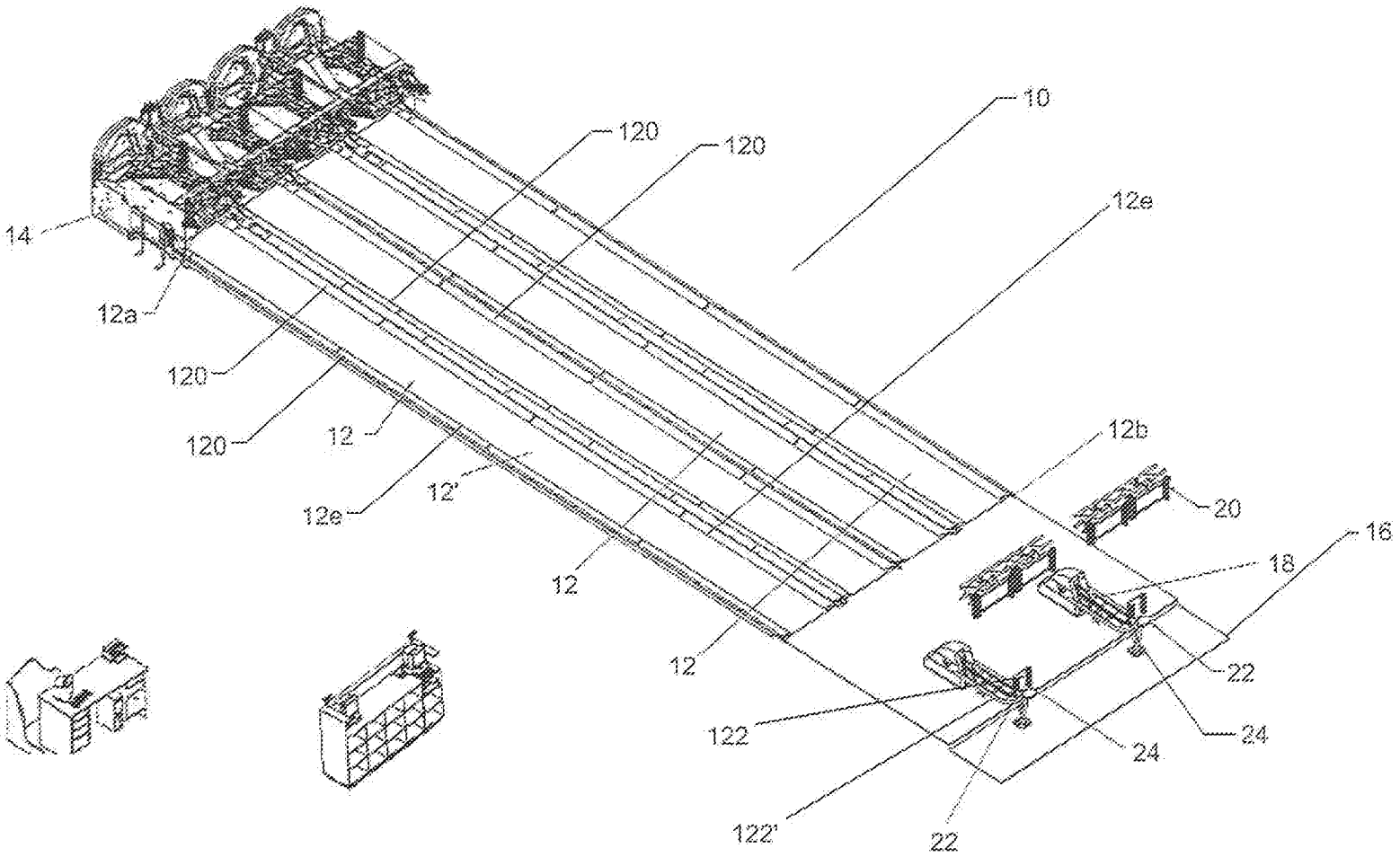
FIG. 1 is a schematic perspective view of a preferred embodiment of the bowling centre according to this invention.

The accompanying drawings, and in particular, FIG. 1, show a preferred embodiment 10 of a bowling centre, which comprises one or more bowling lanes 12 along which the bowl 13 is rolled, at one end of which 12*a* are positioned the pins 15 to be knocked down and at the opposite, longitudinal end of which 12*b* is located the bowlers' bay 13.

The bowling lane 12 has a surface 12' for rolling the bowl towards the pins 15 and extending across opposite lateral edges 12*e*, 12*e*, at each of which there is preferably located a gutter 120 into which the bowl can fall and be conveyed towards a corresponding exit, preferably at the end of the lane occupied by the pins 13.

The lane 12 also comprises a pinspotting machine 14, located at the lane end 12*a* where the pins are positioned, a bowlers' bay 16 at the opposite longitudinal end of the lane, and an apparatus 18 for returning the bowls 13, which brings the bowls 13 back to the throwing zone 12*b*.

Also provided are bumpers 19 which are preferably movable between a lowered position which allows the bowl 13 to roll freely off the lane into the gutter 120 and a raised position for keeping the bowls on the rolling surface of the lane. The bumpers are mounted along the sides of the rolling surface 12' the bowl 13 rolls on and have a respective bowl impact face 191'.

The lane also features the following: a respective overhead monitor or screen 20 which is mounted above the lane and which allows displaying information related to lane events or information issued by the bowling centre, the information possibly including graphical or animated components; and a console 122' allowing bowlers to enter data or commands and mounted on a corresponding supporting member or stand 24.

The bowling centre also comprises an electronic control system which is configured to manage the bowling centre and which, more specifically, can implement the scoring program—that is to say, the program which calculates the scores of the games played in the bowling centre 10 and displays the scores at the respective lanes, specifically on the overhead monitors 20—and which can manage the lighting, sensors, game play, tracking of the bowls, as will become clearer as this description continues.

Preferably, the electronic control system comprises a main electronic processor 101, for example in the form of a PC, in communication with one or more local electronic processors 105 located at the lanes, in particular in the form of PCs, which are in turn connected to the devices for controlling the pinspotting machine 14, to the respective lane console 122' and, if necessary, also to the respective overhead monitor 20.

It is understood, however, that the embodiment of the electronic control system just described must not be considered as limiting the invention.

Figure 2:
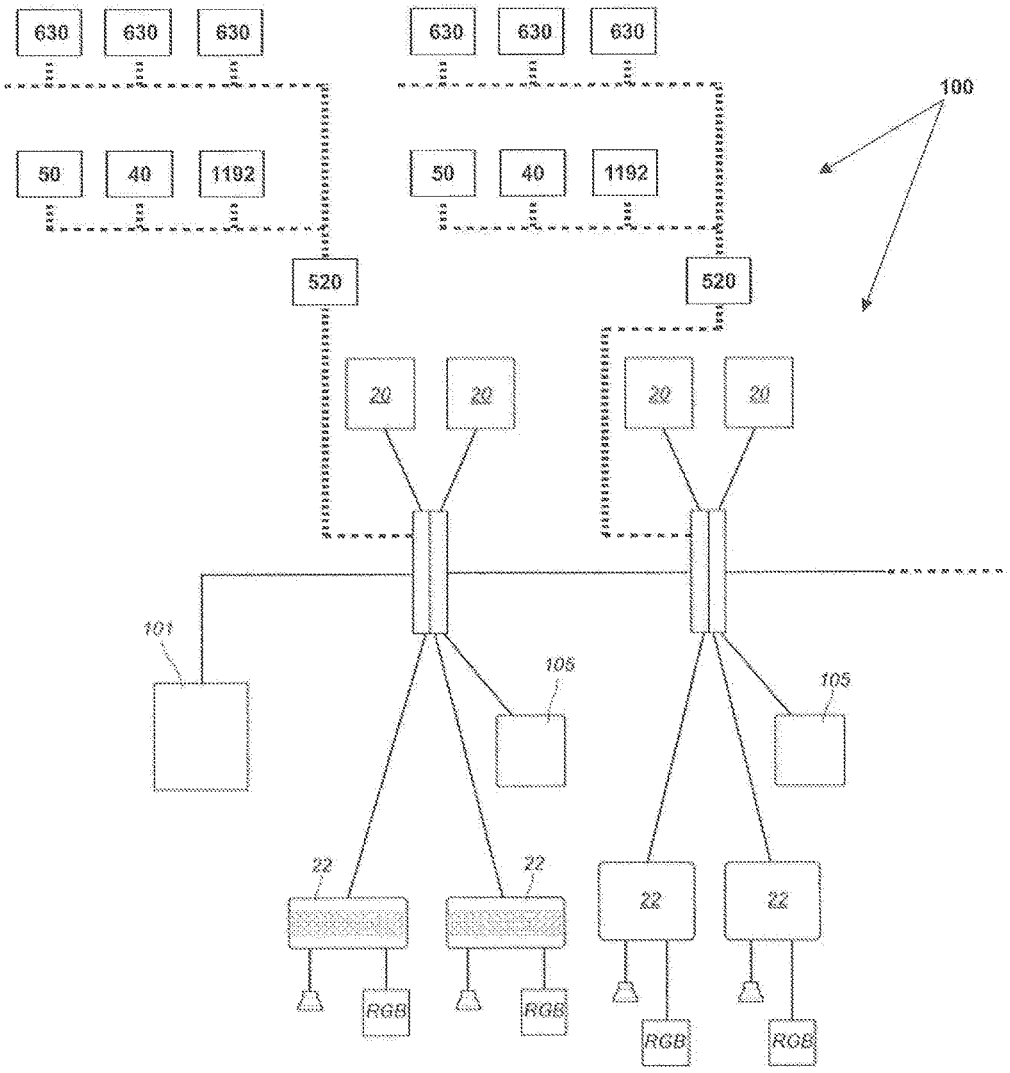
FIG. 2 is a block diagram of a preferred embodiment of the electronic control system of the preferred embodiment of the bowling centre according to this invention.

More specifically, as may be inferred from FIG. 2, the respective local processor 105 is adapted to serve a pair of bowling lanes 12.

Again with reference to FIG. 2, the main electronic processor 101 implements the management system program in known manner, using the data from each electronic lane processor 105 to record and process every game played in the bowling centre and providing operations support for the bowling centre itself. The electronic lane, or local, processor 105 is also configured to control and manage the scoring program and displays the score on the respective overhead monitor 20. In practice, for example, the electronic lane, or local, processor 105 is configured in such a way as to directly implement the game score, displaying it on the corresponding overhead monitor 20 and/or on the lane monitor 122 at the console 122'.

In practice, the electronic control system comprises, at the bowlers' bay, specifically at the lane console, an electronic processor 22 which can implement software functions and applications independently of the main processor 101 and of the lane or local processor 105.

The electronic lane, or local, processor 105 (for example, the lane scoring computer) is a computerized system which manages games on a single lane or on two or more lanes. Although the example described in this document uses a pair of lanes, other configurations are imaginable.

In some embodiments, the scoring system (like other control systems described in this document) comprises a main CPU connected to:

- a local monitor (typically the overhead monitor above the lane);
- input/output devices interfaced with the pinspotting machines;
- input/output devices which collect information relating to the moment the bowl is thrown, the number of pins knocked down, any fouls detected and other relevant information available at the lane regarding the bowl thrown; and
- the input/output console (keypad, LCD or the like) to allow the scoring system to interact locally with the bowlers at the lane.

By way of example, the computer device which implements the score program may be, without distinction, any one of the processors of the bowling centre (for example, the main processor 101, the lane processor 105, the console processor 22 or any other computer system), even if the one preferably used for the purpose is the lane processor 105.

The computer server and/or device which implements the scoring program is capable of communicating through any communications network such as, for example, an intranet, a LAN, a WAN, the Internet, etc. Whatever the case, the device which implements the scoring program may reside in a network infrastructure or in a computer device belonging to a third party provider.

By way of example, the respective computer device or processor may comprise a processor (CPU), a memory, an input/output interface and a bus. Further, the respective computer device or processor may also comprise a random access memory (RAM), a read-only memory (ROM) and an operating system (O/S). The computer device is adapted to communicate with the external input/output device and with the memory system. The input/output device may comprise any device that allows a person to interact with the computer device (for example, a user interface) or any device that allows the computer device to communicate with one or more other computer devices through a connection of any kind. The external input/output device may be, for example, a palmtop computer, a smartphone, a personal digital assistant, a hand-held controller, a keyboard, a system for converting sounds into electrical signals to be sent to the scoring system or a management system for generating an event used to activate a special effect, etc.

Generally speaking, the processor executes a respective program code (e.g. a program control) which can be stored in the respective memory.

As will be evident to an expert in the trade, the program code may be a computer program, method or system. Consequently, the aspects of this invention can be implemented entirely by hardware, entirely by software (including firmware, resident software, microcode or the like) or in any form which combines both the software aspects and the hardware aspects.

Further, the aspects of this invention may be in the form of a computer program stored on one or more mediums containing computer-readable program code. One or more computer mediums can be used in any combination. A computer-readable medium is non-transient in nature: for example, it is not in itself a signal. By way of non-limiting example, the computer-readable medium may be an electronic, magnetic, optical, electromagnetic, infrared or semiconductor device, apparatus or system or any combination of these. More specific examples (a non-exhaustive list) of computer-readable mediums might comprise the following elements: an electrical connection to one or more wires, a portable disk, a hard disk, a random access memory (RAM), a read-only memory (ROM), an erasable programmable read-only memory (EPROM or flash memory), an optical fibre, a compact disc read-only memory (CD-ROM), an optical storage device, a magnetic storage device or any combination of these. In the context of this document, a computer-readable medium may be any physical medium capable of containing or storing a program and usable by, or in relation to, an apparatus or device for executing instructions. The computer-readable medium is not in itself a signal. The computer-readable medium is non-transient in nature.

This preferred embodiment 10 of the bowling centre also comprises, in particular for each lane, a lighting system, specifically controlled by the electronic control means of the bowling centre, as will become clearer as this description continues.

More specifically, the lighting system advantageously comprises a plurality of lighting units 31 and the electronic control system 100 controls each lighting unit 31 individually, that is, independently of the others.

That way, special light effects can be created at each lane or in the bowling centre as a whole in order to underline specific game sequences, which are, in particular, desirable or advantageous for the players.

More specifically, each lighting unit 31 advantageously comprises one or more, preferably a pair of, lighting devices 30, which are described in more detail hereinafter in this description.

Advantageously, in a preferred embodiment, the lighting system, specifically the lighting devices, or units 31 allow lighting substantially the entire longitudinal extension of the lane, the lighting units 31, or device 30, being, in particular, distributed substantially along the full length of the lane.

Advantageously, the electronic control system 100 controls the lighting system, in particular each lighting unit 31, in such a way as to light respective zones of the bowling lane 12 in a differentiated manner and/or in such a way as to light respective zones of one or both bumpers 19 in a differentiated manner, as will become clearer as this description continues.

Advantageously, the electronic control system 100 controls the lighting system, in particular each lighting unit 31, in such a way as to light respective longitudinal zones of the bowling lane in a differentiated manner and/or in such a way as to light respective longitudinal zones of one or both bumpers 19 in a differentiated manner, as will become clearer as this description continues.

Advantageously, the electronic control system 100 controls the lighting system, in particular each lighting unit 31, in such a way as to light respective zones of the bowling lane and/or in such a way as to light respective zones 19' of the respective bumper 19 selectively and variably according to respective game events and/or according to respective game modes set by the bowling scoring program, as will become clearer as this description continues.

Advantageously, the electronic control system 100 controls the lighting system, in particular each lighting unit 31, in such a way as to selectively differentiate the type of lighting emitted, in particular, the colour of the lights according to respective game events and/or according to respective game modes set by the bowling scoring program.

For this purpose, advantageously, the electronic control system 100 controls the lighting system, in particular each lighting unit 31, or lighting device 30, in such a way as to differentiate the type of lighting, in particular, the colour of the lights, emitted by each lighting unit 31 and/or by each individual lighting device 30.

In practice, the type of lighting, in particular the colour of the lighting provided by the each lighting unit 31, in particular of the single lighting device 30, is determined, in particular varied selectively, by the electronic control system 100.

In practice, the zone and/or the respective zone lighting is determined, in particular varied selectively, by the electronic control system 100 of the bowling centre, in particular to highlight respective game events and/or respective game modes set by the bowling scoring program.

Advantageously, the electronic control system 100 controls the lighting system, in particular each lighting unit 31, in such a way as to light respective zones of the bumper with a respective colour, for example green in the case of zones which must be struck by the bowl 13, or red in the case of zones which must not be struck by the bowl 13.

Advantageously, the electronic control system 100 of the bowling centre subdivides the lane 12 into longitudinal zones and, in particular, selectively modifies the subdivision, that is, selectively varies the length of the longitudinal lane zones, in particular lighting in a correspondingly differentiated manner the longitudinal lane zones, that is, the corresponding zones 19' of the respective bumper, preferably according to the instructions of, or under the control of, the scoring program.

In other words, the length of the respective longitudinal zones of the bowling lane, or of the respective bumper, to be lit is determined selectively, in particular varied, by the electronic control system 100, according to the instructions of, or under the control of, the scoring program, in order to implement specific game sequences.

Figure 18:
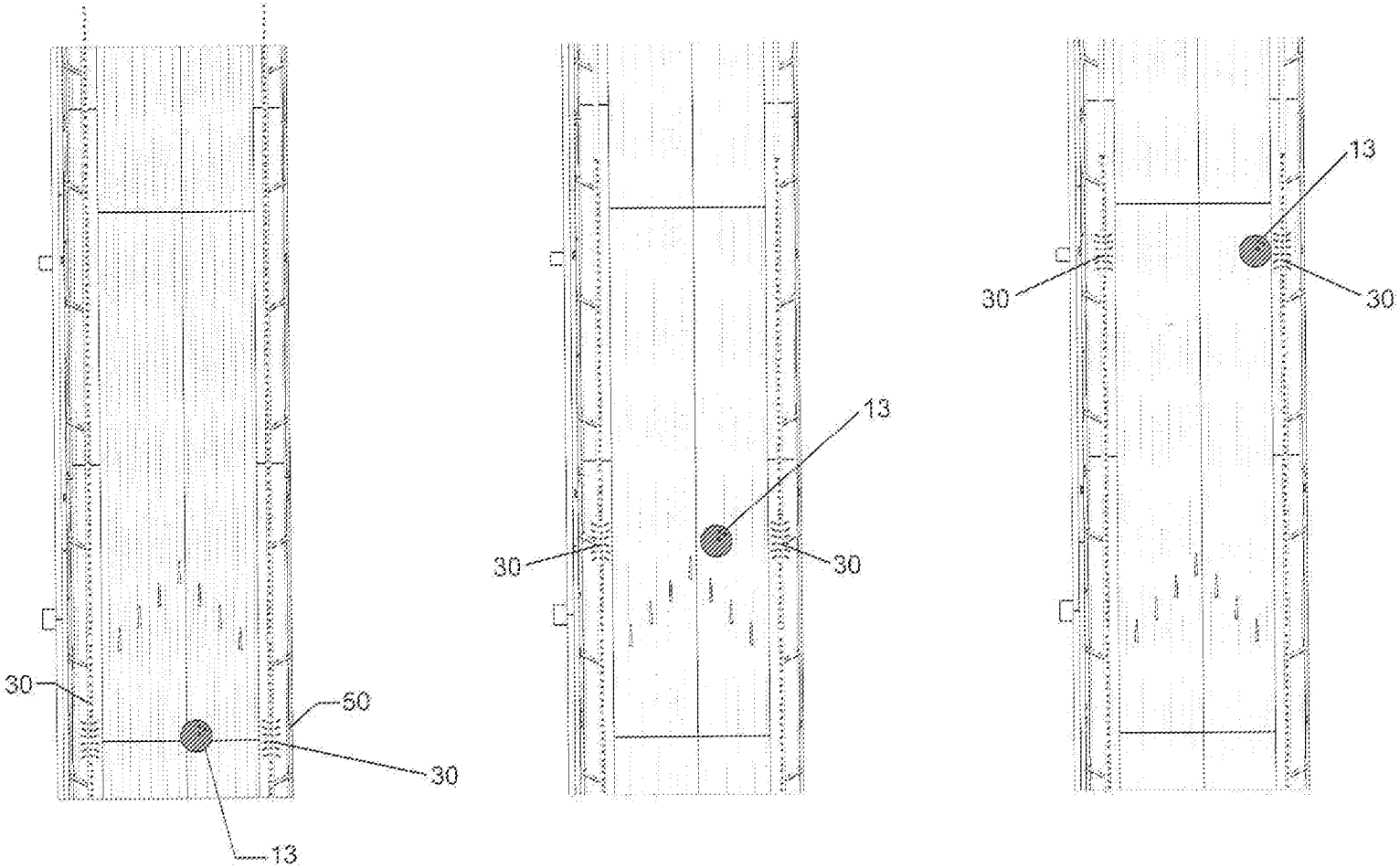
FIG. 18 shows three different moments in the movement of the bowl along the bowling lane, followed by the lighting as it rolls down the lane.

In particular, as may be inferred from FIG. 18, and as will become clearer as this description continues, the electronic control system 100 advantageously, controls the lighting system, in particular each lighting unit 31, in such a way as to follow the bowl 13 as it rolls down the lane 12, especially in response to signals received from the bowl detection system 40, 50, preferably in such a way as to light the lane zone where the bowl 13 is or has passed, in particular lighting the corresponding zone of the respective bumper, or of both bumpers 19.

Advantageously, the lighting system, in particular the respective lighting units 31 or devices 30, is located at the lane 12, the lighting units 31 or devices 30 being, in particular, longitudinally distributed along opposite sides 12*e*, 12*e* of the lane 12.

Figure 4:
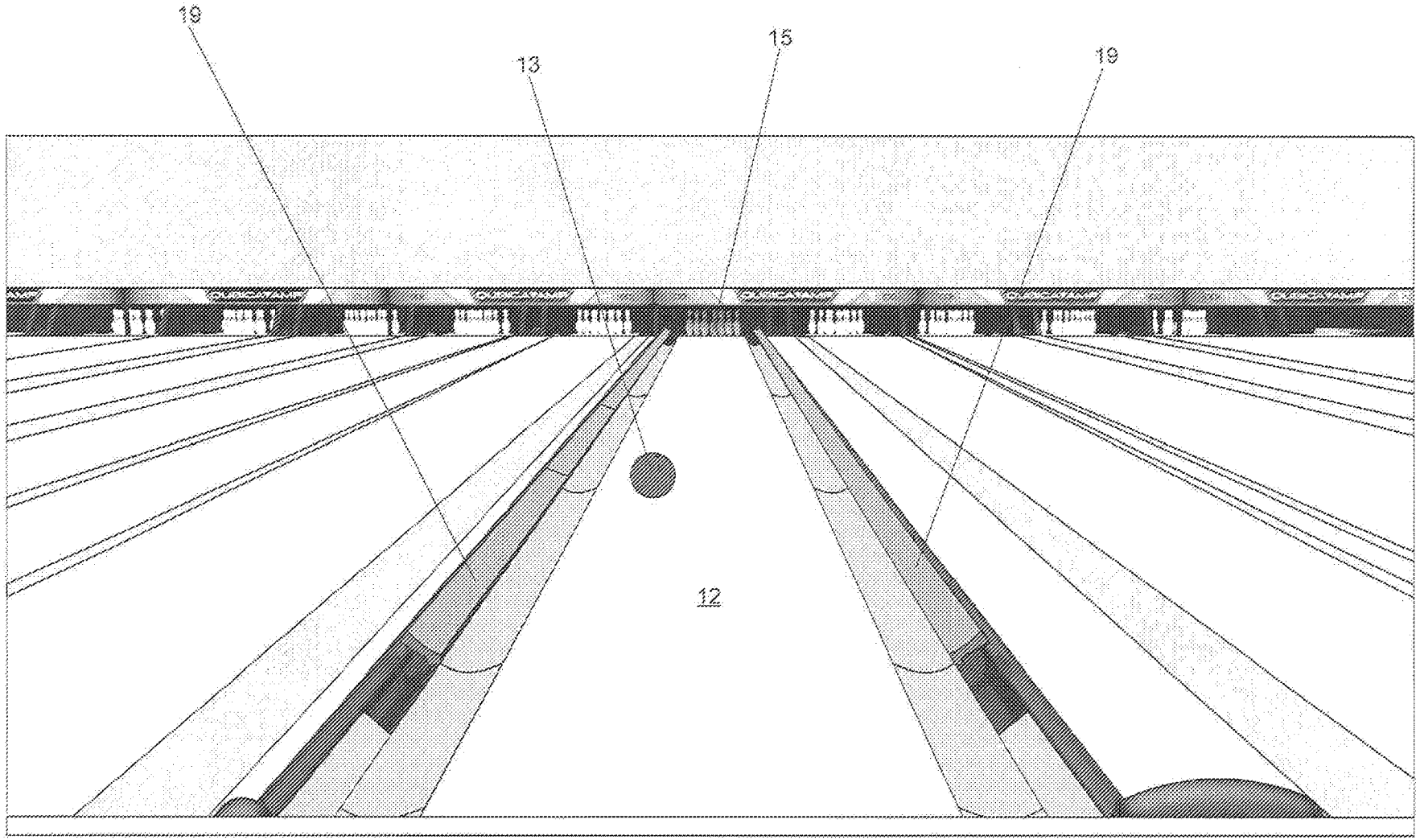
FIG. 4 is a schematic perspective view of a bowling lane of the preferred embodiment of the bowling centre according to this invention, showing both the bumpers lit up in the same way.
Figure 5A:
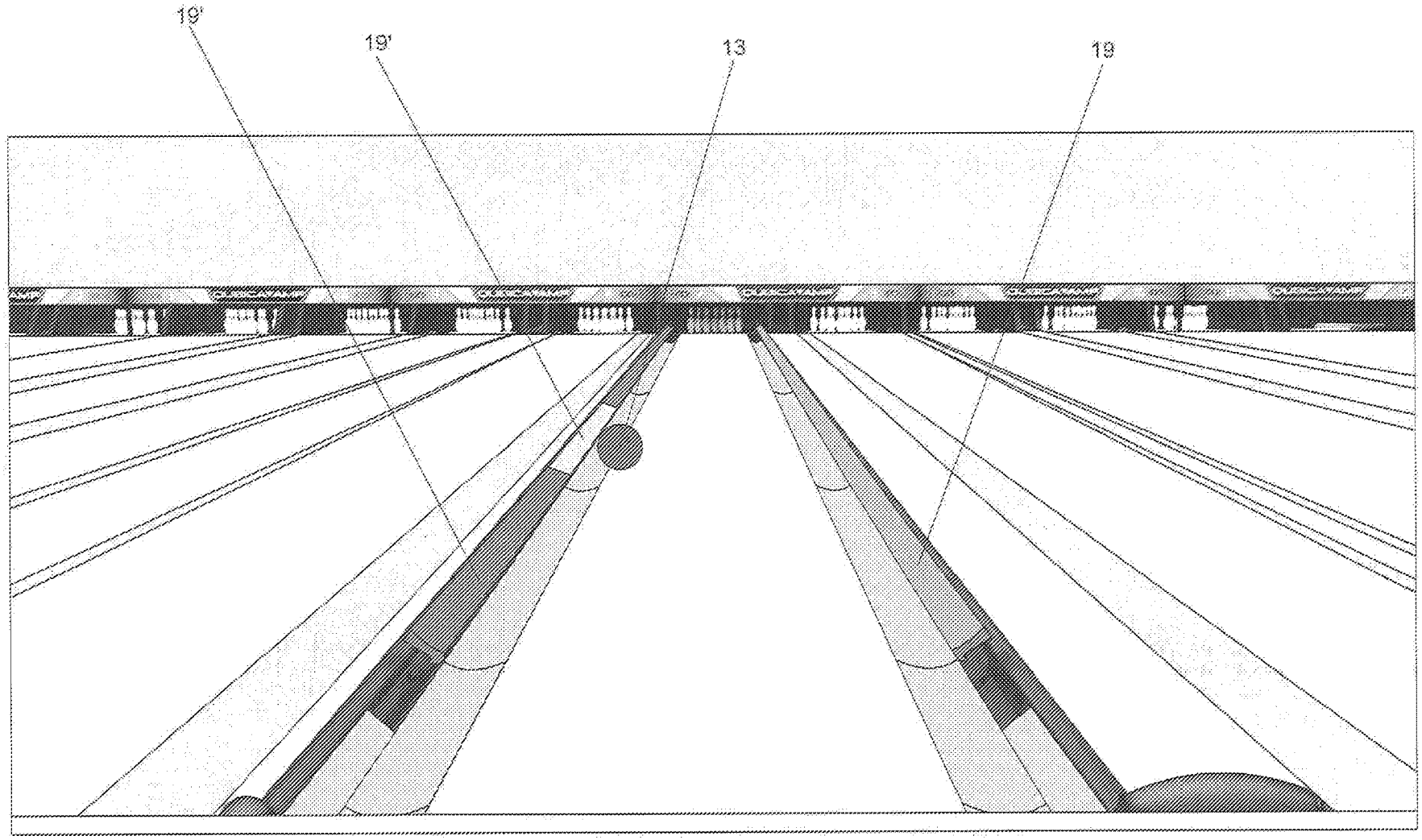
FIG. 5A is a schematic perspective view of a bowling lane of the preferred embodiment of the bowling centre according to this invention, showing one bumper fully lit and the other bumper lit only at the point where the bowl touches it.
Figure 5B:
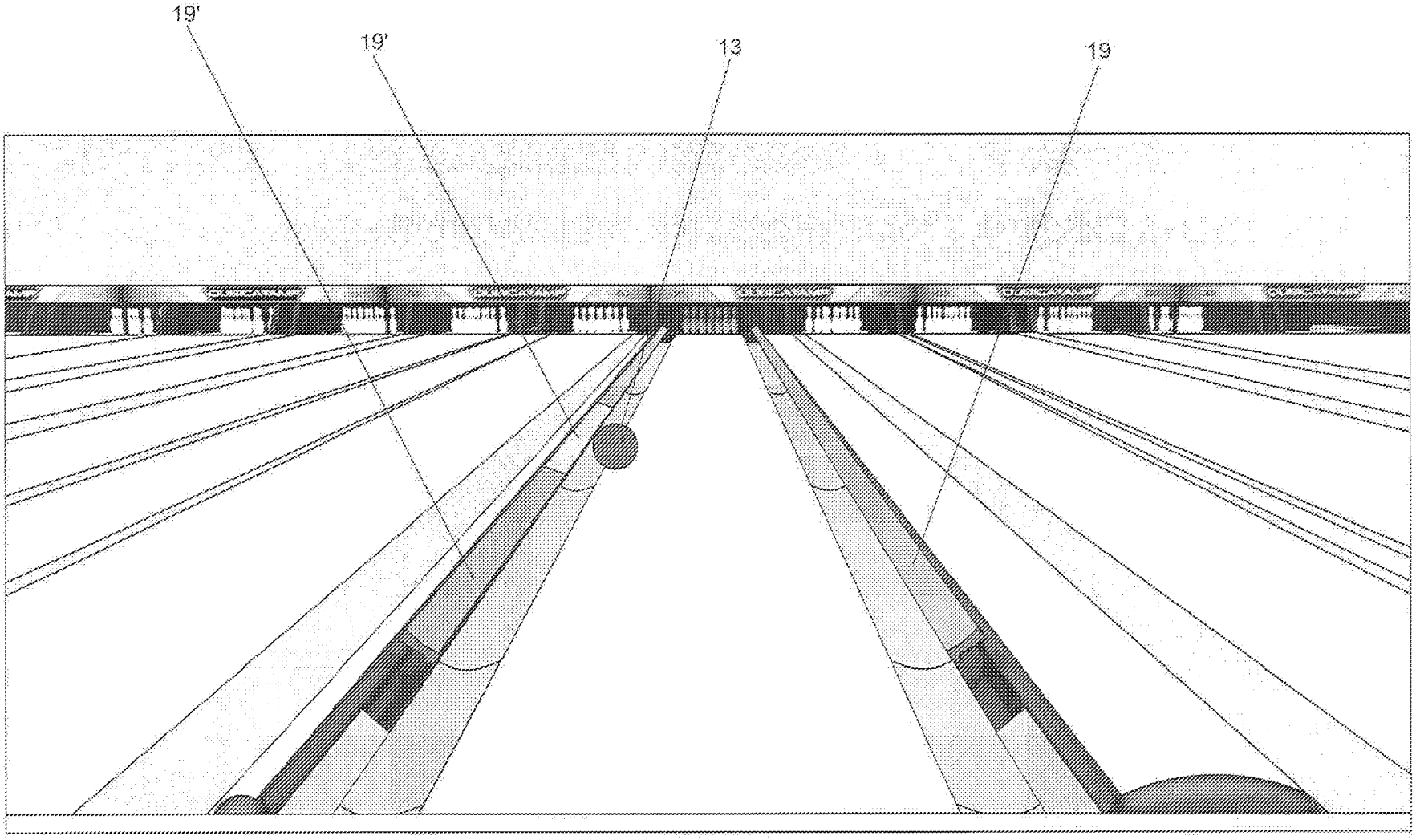
FIG. 5B is a schematic perspective view of a bowling lane of the preferred embodiment of the bowling centre according to this invention, showing one bumper fully lit and the other bumper also fully lit but with lighting differentiated by zones.
Figure 6:
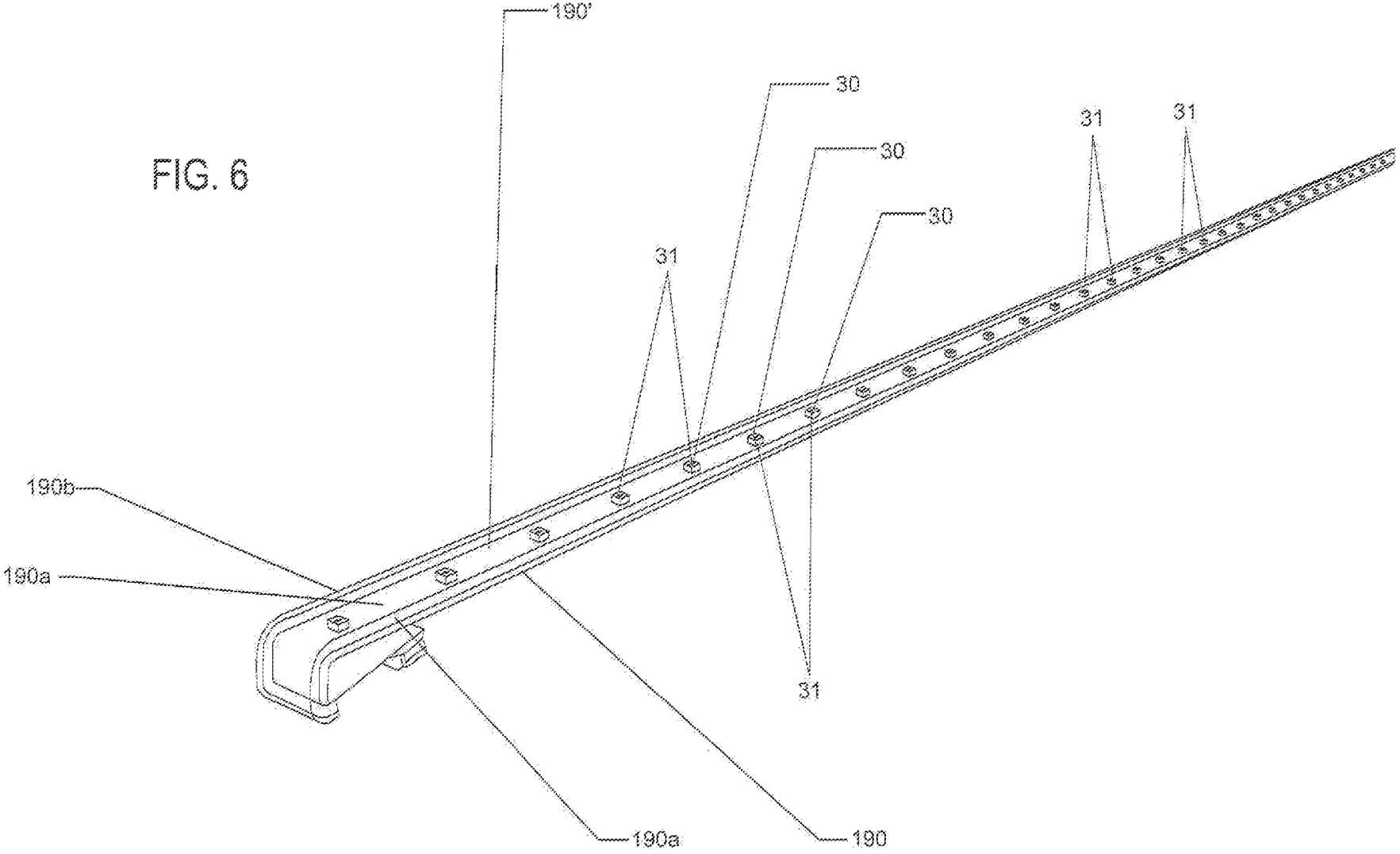
FIG. 6 is a schematic perspective view of the element which directly supports the lighting devices in the preferred embodiment of the bowling centre according to this invention.

Advantageously, as may be inferred from FIGS. 4 to 6, the lighting system, in particular the respective lighting unit 31 or device 30, is mounted on the respective bumper 19, in particular on both bumpers 19, 19; the lighting units 31 or devices 30 are, in particular, longitudinally distributed on the respective bumper 19.

That way, the bumpers are able to perform a further, advantageous function which provides the lanes with a novel and more attractive lighting arrangement.

More specifically, as may be inferred from the drawings, the lighting units 31 are equidistant from each other. For example, the distance between the lighting units 31 might be around 61 mm.

In practice, as may be inferred in particular from FIGS. 4 to 6, there is advantageously provided a corresponding plurality of lighting devices 30, forming respective lighting units, in particular mounted to the respective bumper 19, which are distributed along the longitudinal direction of the lane, specifically a first and a second plurality of longitudinally spaced devices 30 being disposed on opposite sides 12*e*, 12*e* of the lane 12.

Advantageously, the respective plurality of lighting devices 30 is contained in a respective protective element made of transparent material, as will become clearer as this description continues.

Advantageously, each lighting device 30 is in the form of a LED, specifically an RGB multicolour LED.

That way, the colour of the lighting can be varied at will.

Advantageously, as may be inferred from the drawings, the respective lighting units 31 or devices 30 are mounted along the upper zone of the respective bumper 19, in particular above a corresponding face 190' of the bumper 19 which, in use, is directed at least partly upwards and preferably on a face 190' of the bumper 19 which is inclined at an angle to the horizontal—that is, to the rolling surface 12' the bowl 13 rolls on—and which is directed towards the lane 12 the bumper is associated with. More specifically, the face 190' which the lighting devices 30 are mounted to, is at right angles, or substantially at right angles, to the direction of extension of the respective arm 192 for raising and lowering the bumpers, this arm being described in more detail further on in this description.

Advantageously, the respective lighting units 31 or devices 30 are adapted to light the lane 12 where they are mounted and, in particular, also the lanes 19 adjacent thereto.

Advantageously, the respective lighting units 31 or devices 30 are visible when the bumper 19 is in the raised condition and preferably also when the bumper 19 is in the lowered condition.

That way, the lighting system can be used at all times, independently of the bumpers.

Advantageously, as may be inferred in particular from FIGS. 4 to 5B, the lighting units 31, or devices 30, allow lighting the entire longitudinal extension along which they are situated—that is, the full length of the bumper 19—and/or only one or more longitudinal zones, or stretches, of the lane, specifically only one or more longitudinal zones, or stretches 19' of the bumper 19 where they are situated—that is, they allow lighting with different-coloured lights different longitudinal zones, or stretches, of the lane, specifically different longitudinal zones, or stretches 19' of the bumper 19 where they are situated.

Preferably, therefore, the respective lighting devices 30 of the first and second plurality of devices 30 are transversely aligned, or substantially transversely aligned, with each other.

More specifically, in this embodiment, the lighting system has a respective electronic control system which is, in particular, in communication with the electronic control system of the bowling centre, preferably with the local control system of the respective lane.

Advantageously, as may be inferred from FIG. 2, each lighting unit 31 is controlled by a respective and dedicated control device 630.

As stated, and as may be inferred from FIG. 2, the respective lighting units 31 are individually addressable or drivable, each unit being, in particular, controlled by the respective and dedicated control device 630.

Advantageously, as may be inferred in particular from FIG. 2, the electronic control system 100 of the bowling centre comprises, for each lane 12, a respective electronic control processor 520 for the lighting system of the respective lane, the processor 520 being in communication with the control device 630 of the lighting unit 31 of the respective lane.

It follows, therefore, that the control system 520 of the electronic lighting system 30 of the respective lane, is in turn connected to the local electronic lane processor 105 and/or with the main electronic processor 101 of the bowling centre. Although this embodiment is especially preferred, it is understood, however, that the embodiment of the lighting control system just described must not be considered as a limiting feature of the invention and that other specific embodiments are imaginable.

More specifically, the plastic upper bumper rail section 191 is designed in a way as to be hollow on the inside allowing a LED light strip or array to be inserted in it to create a lighting effect on the lane As stated, the position and orientation of the LEDs when the bumpers are in the lowered position allows the LEDs to be visible not only to the bowlers playing on the lane where the LEDs themselves are, but also to bowlers in adjacent lanes. This allows creating light effects in two or more lanes where each LED strip is driven independently through the bumper control server 520 which may, in turn also be driven by the scoring system 105 or by the management system 101.

As stated, the LED units are advantageously addressable individually through a LED driver card 630 which receives instructions from the bumper control server 520 which is connected to the scoring system 105 and/or to the management system 101.

By means of RGB multicolour LEDs mounted on the upper portion of the bumper structure, one or more selected areas of the bumpers can be highlighted e.g. by lighting up these areas while leaving the other LEDs switched off, or by instructing the RGB LEDs of the selected areas to display a specific colour. This differentiated lighting may be used to distinguish one or more bumper areas from the others.

Advantageously, the bowling centre comprises a bowl detection system for detecting the bowl as it rolls down the bowling lane.

Figure 7:
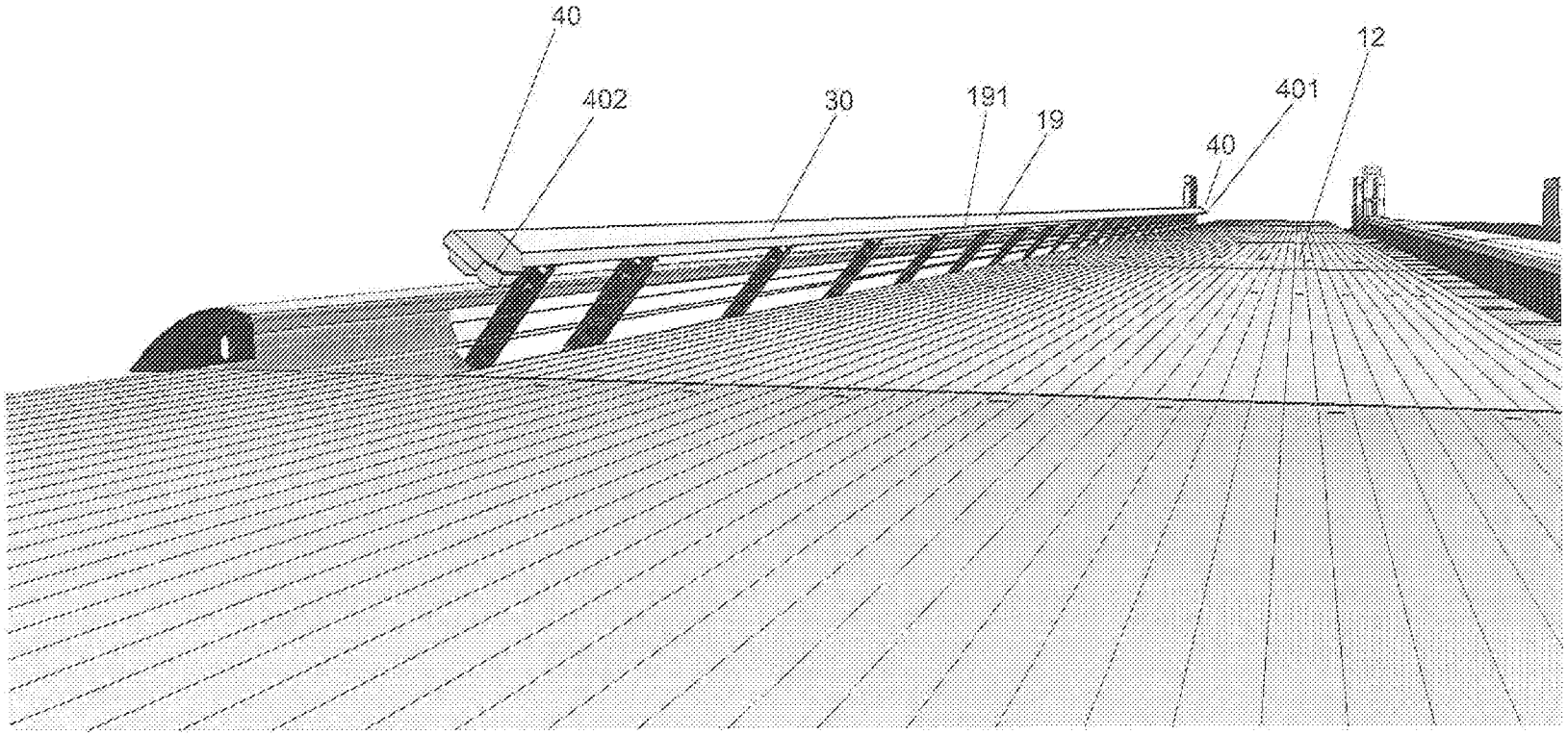
FIG. 7 is a schematic perspective view of the preferred embodiment of the bowling centre according to the invention, with the bumper in the raised working condition, and showing, in particular, the sensor which detects impact or proximity between bowl and bumper.
Figure 8:
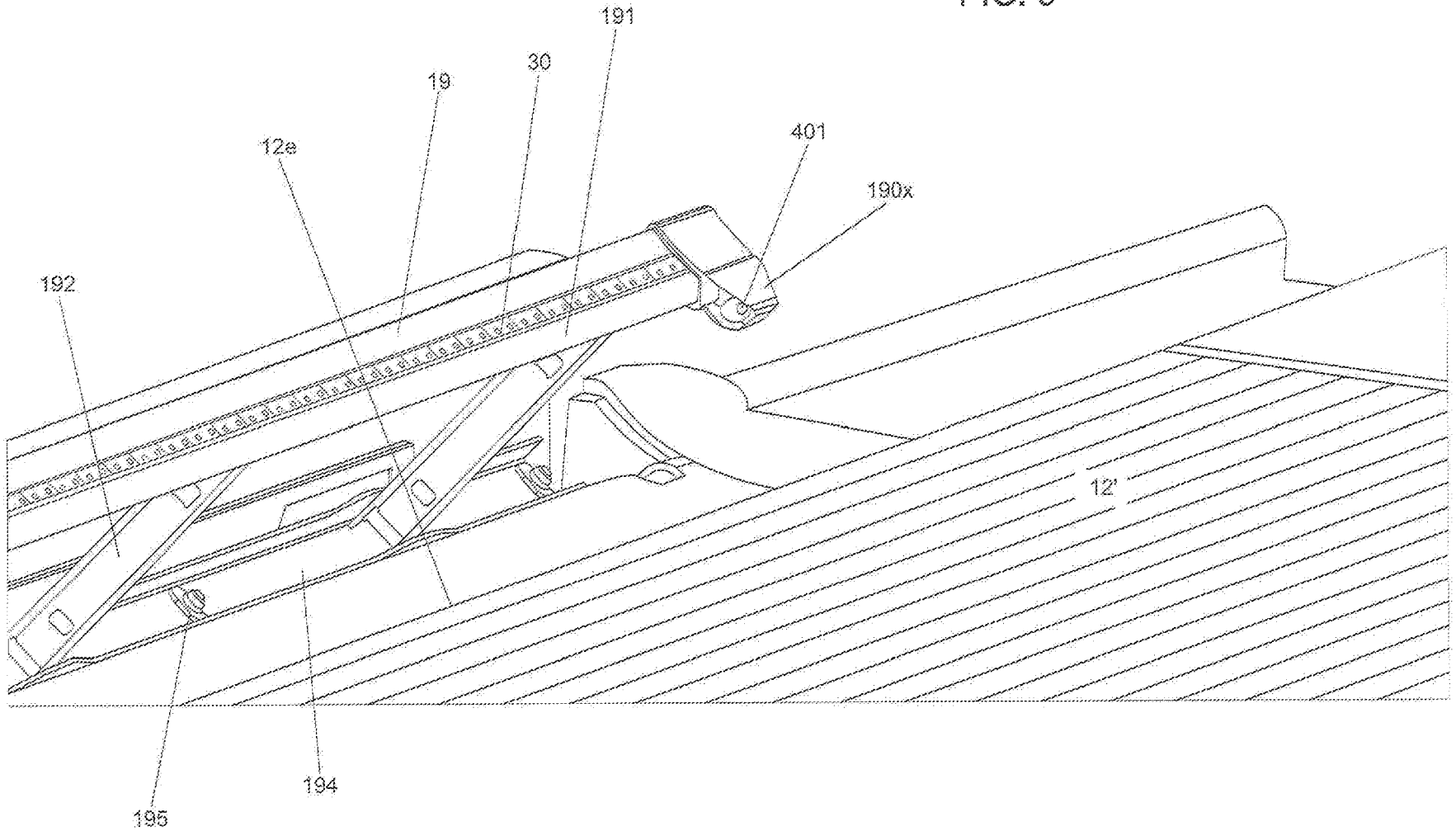
FIG. 8 is a schematic perspective view of a detail of the end of a bumper in the preferred embodiment of the bowling centre according to this invention.
Figure 9:
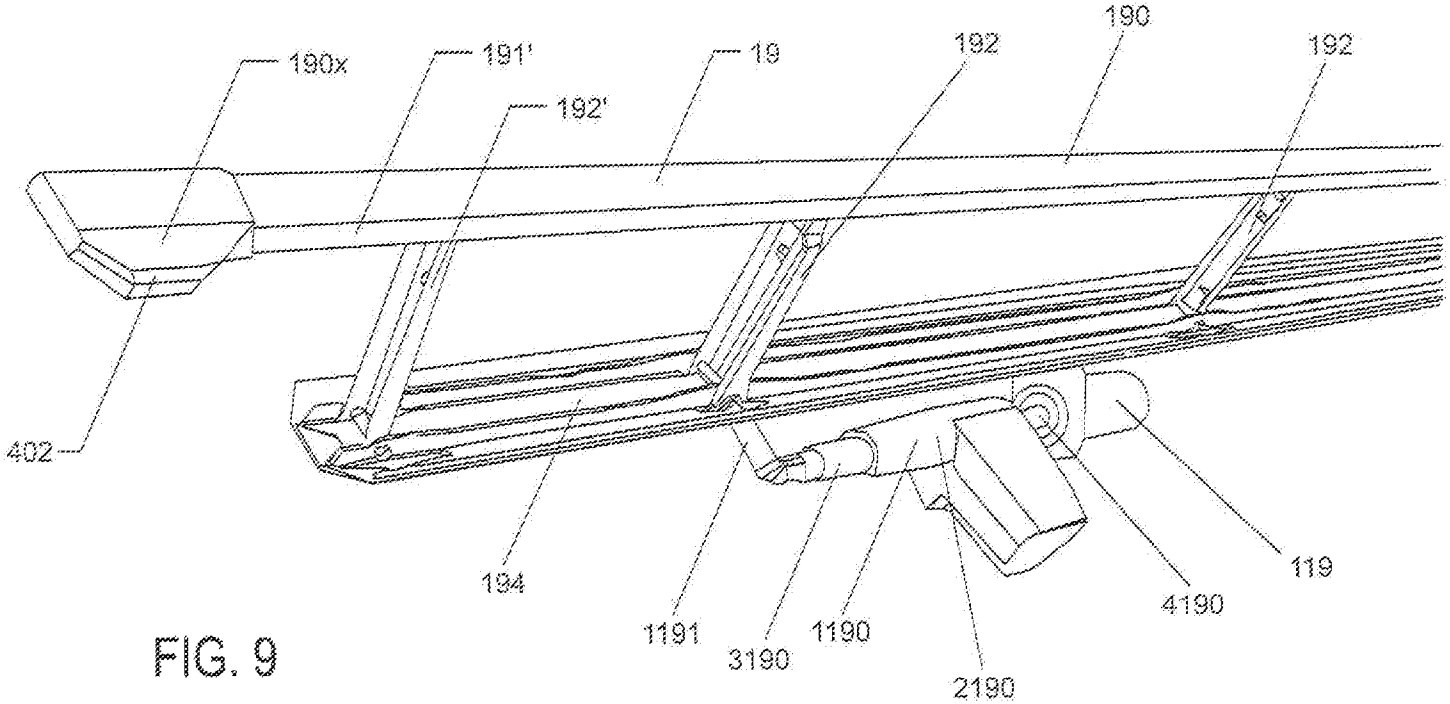
FIG. 9 is a schematic perspective view of the preferred embodiment of the bowling centre according to the invention, illustrating in particular the opposite end of the same bumper and showing the apparatus for raising/lowering the bumper.

Advantageously, as may be inferred in particular from FIGS. 7 to 9, the bowl detection system for detecting the bowl as it rolls down the bowling lane comprises one or more sensors 40 for detecting bowl proximity to, or impact with, the respective bumper 19.

Advantageously, as may be inferred from FIGS. 7 to 9, the one or more sensors 40 for detecting bowl proximity to, or impact with, the respective bumper 19 are operational when the bumper 19 is in the extracted condition, that is to say, when it protrudes upwards from the rolling surface 12' of the lane 12.

Advantageously, as may be inferred from FIGS. 7 to 9, the one or more sensors 40 for detecting bowl proximity to, or impact with, the respective bumper 19 are mounted on the bumper 19 itself and are preferably hidden from view, specifically underneath the bowl gutter, when the bumper is in the respective lowered position.

Advantageously, as may be inferred from FIGS. 7 to 9, each bumper sensor 40 is located on the face 191' of the bumper 19 which is designed to be struck by the bowl 13.

Advantageously, each bumper sensor 40 is in the form of a non-contact sensor, in particular in the form of an optical sensor, preferably of the infrared type.

Advantageously, as may be inferred from FIGS. 7 to 9, each bumper sensor 40 comprises a first and a second sensor device 401, 402 across which a corresponding detecting radiation is transmitted, in particular in the form of a transmitter element 401 for transmitting the detecting radiation and a receiving element 402 for receiving the detecting radiation, the elements 401, 402 of the sensor 40 being preferably situated on the opposite longitudinal sides of the respective stretch of the lane 12 or of the respective stretch of the bumper 19, being in particular situated on the opposite longitudinal sides of the respective lane 12 or on the opposite longitudinal sides of the entire bumper 19.

Preferably, as may be inferred in particular from FIG. 2, the one or more bumper sensors 40 of the respective lane 12, are connected to a respective control processor 520, in particular by the processor which controls the lane bumper lighting system.

In practice, the bumper contact or proximity sensors are optical infrared sensors with a transmitting source TX disposed on one longitudinal side of the lane and a receiving source RX disposed on the corresponding opposite longitudinal side of the lane.

The TX-RX pair is, as illustrated, preferably mounted at the two opposite terminal ends of the plastic bumper rail 191.

These sensors can detect if a ball comes sufficiently near to the bumper rail structure, whether it touches it or just comes sufficiently near to be considered as a contact (i.e. in our application we prefer a non-contact that the bowler perceives as a contact to be registered by the system as a contact, as against a situation where the ball does physically touch the bumper but the sensing means used do not register the contact because of sensibility issues, or noise, interference or other limitations.

The system, as will become clearer as this description continues, is capable of detecting the position of a bowl both longitudinally along the lane and relative to each of the bumper rails on the right and left in order to determine whether the bowl has touched or nearly touched the bumper rail, as described above.

Figure 16:
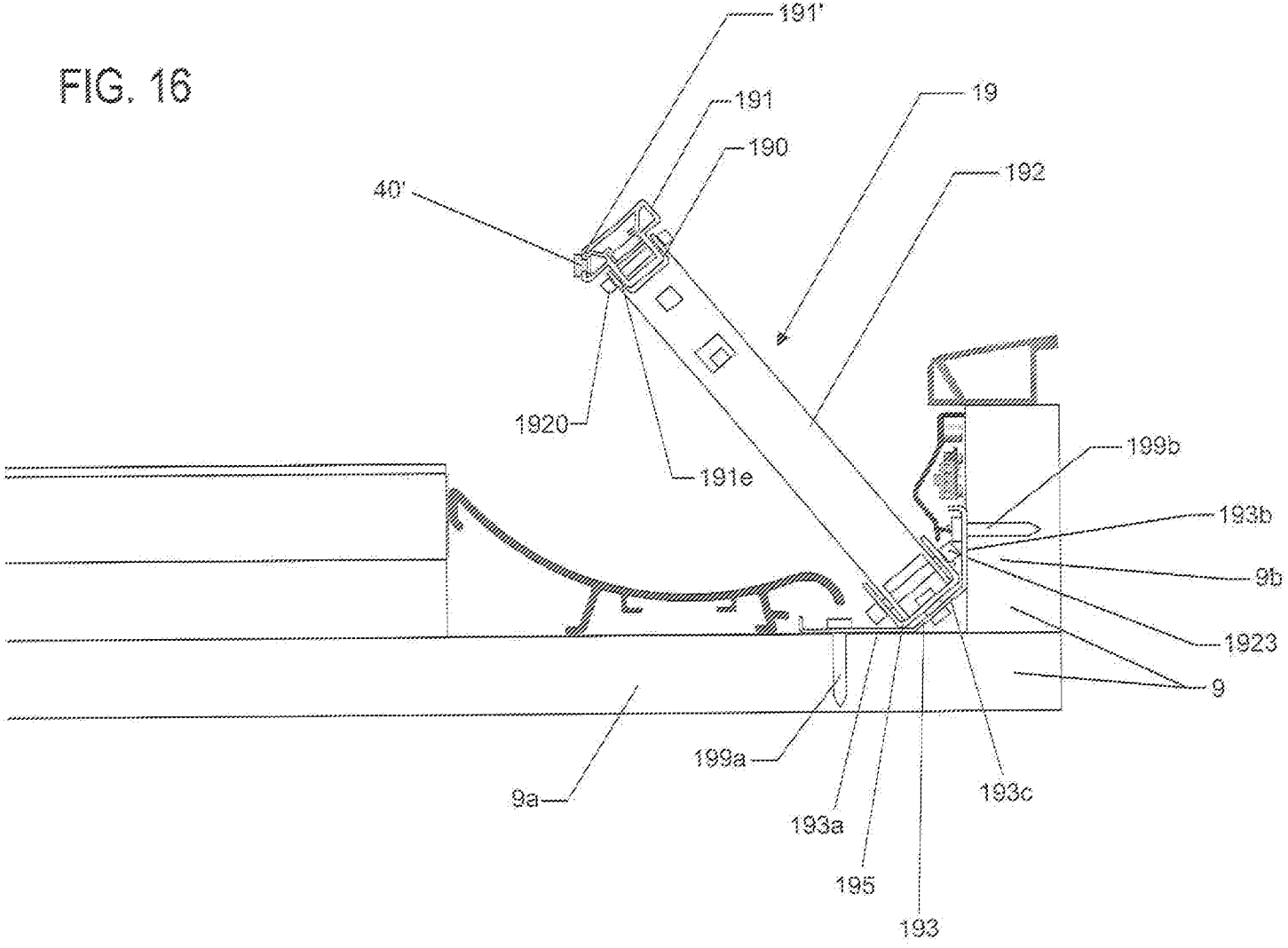
FIG. 16 is a view similar to FIG. 14, from the end of the bumper which is close, or adjacent, to the players' bowl throwing position.

Advantageously, according to another embodiment, as may be inferred in particular from FIG. 16, the one or more bumper sensors may also be contact sensors 40', preferably defined by one or more sensor strips positioned at the face 191' of the bumper 19 to be struck by the bowl 13.

The sensors 40' are in the form of electrical sensors such as, for example, the sensors known as "ribbon switches" made and marketed by the American "Tapeswitch Corporation" or like products.

The electrical sensors 40' react to the pressure (determined, in this case, by the impact of the bowl) by placing in contact with each other two parallel conductors extending along the full length of the sensor and they can therefore be mounted along the full length of the bumper at the contact surface between the bowl and the bumper.

That way, in addition to detecting bowl contact, it is also possible to determine the position where the contact occurred. This is achieved using known methods of processing the signal provided by the ribbon switch, preferably based on the propagation time of the electrical signal or on the resistive/ohmic property of the two conductors when they touch each other.

Advantageously, therefore, the detection system for detecting the bowl as it rolls down the bowling lane is designed to determine, in particular to estimate or calculate, the position of the bowl 13 along the bowling lane 12.

More specifically, the detection system for detecting the bowl as it rolls down the bowling lane is designed to determine, in particular to estimate or calculate, the longitudinal zone or stretch of the lane 12 where the bowl 13 is located.

Advantageously, therefore, the detection system for detecting the bowl 13 as it rolls down the bowling lane is designed to determine the speed of the bowl 13 rolling down the bowling lane 12.

Figure 10:
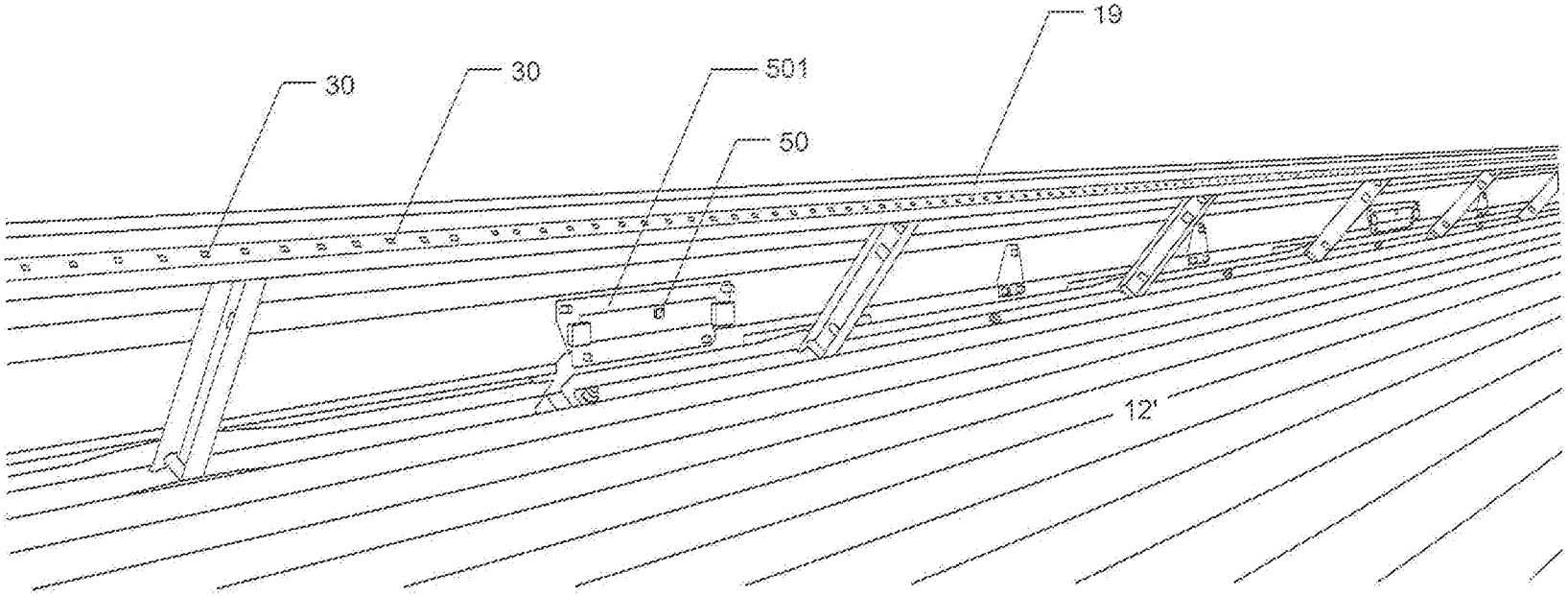
FIG. 10 is a schematic perspective view of a bumper zone in the preferred embodiment of the bowling centre according to the invention, illustrating in particular the lighting devices and the lane sensor.
Figure 11:
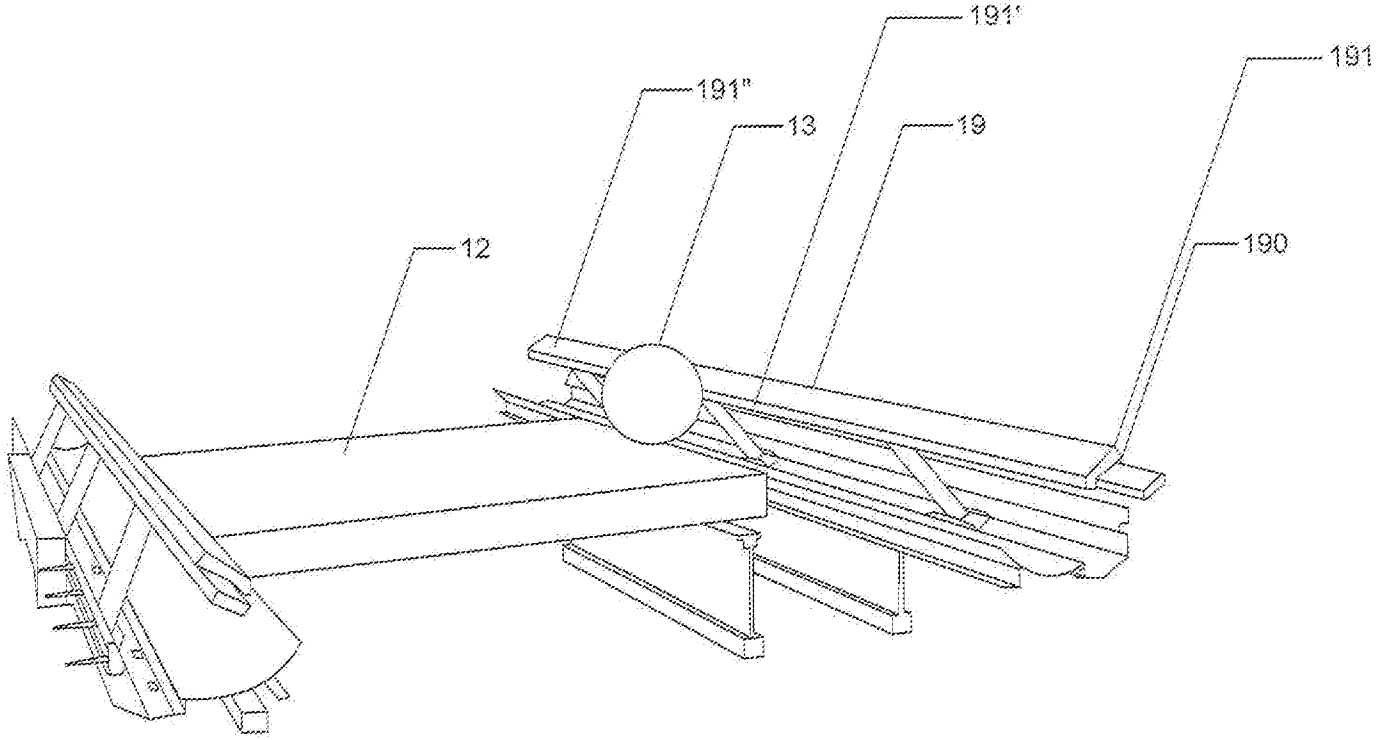
FIG. 11 is a schematic perspective view of a detail of the bowling lane and of the respective bumpers in the raised condition.
Figure 12:
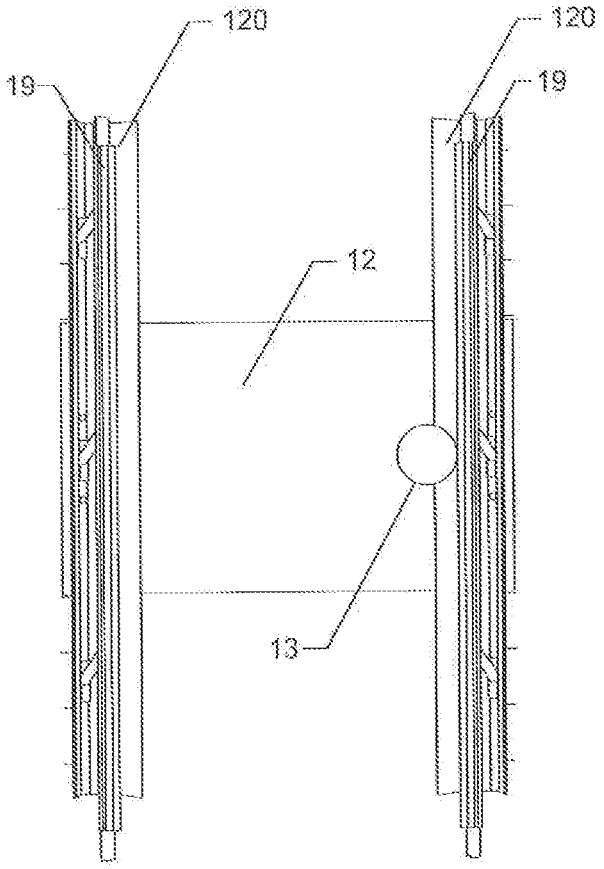
FIG. 12 is a schematic top plan view of the detail of FIG. 11, highlighting the transverse distance between the bumper in the raised condition and the corresponding lateral edge of the lane.
Figure 13:
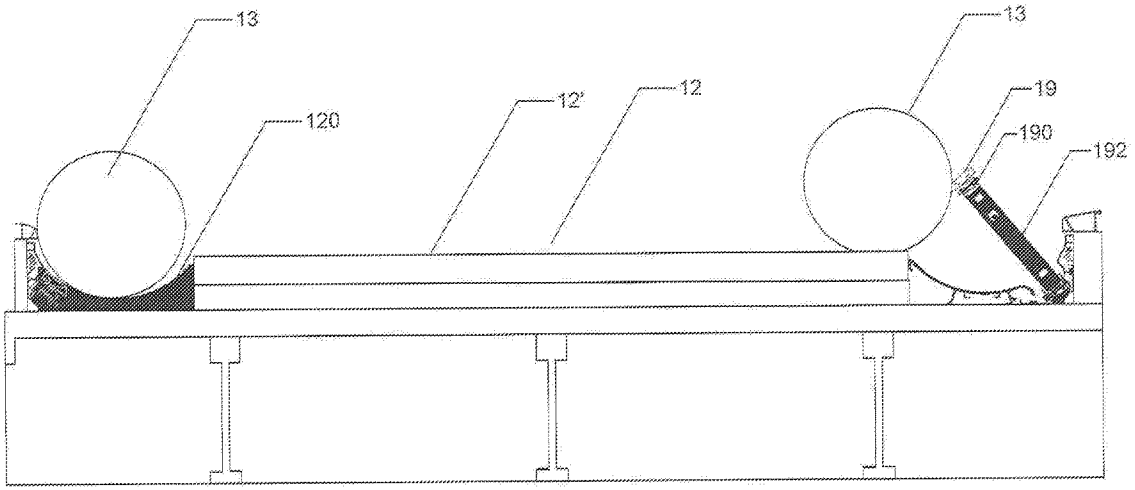
FIG. 13 is a schematic transverse cross section showing the lane, the bowl gutters and the respective bumpers in the raised and lowered condition.
Figure 17:
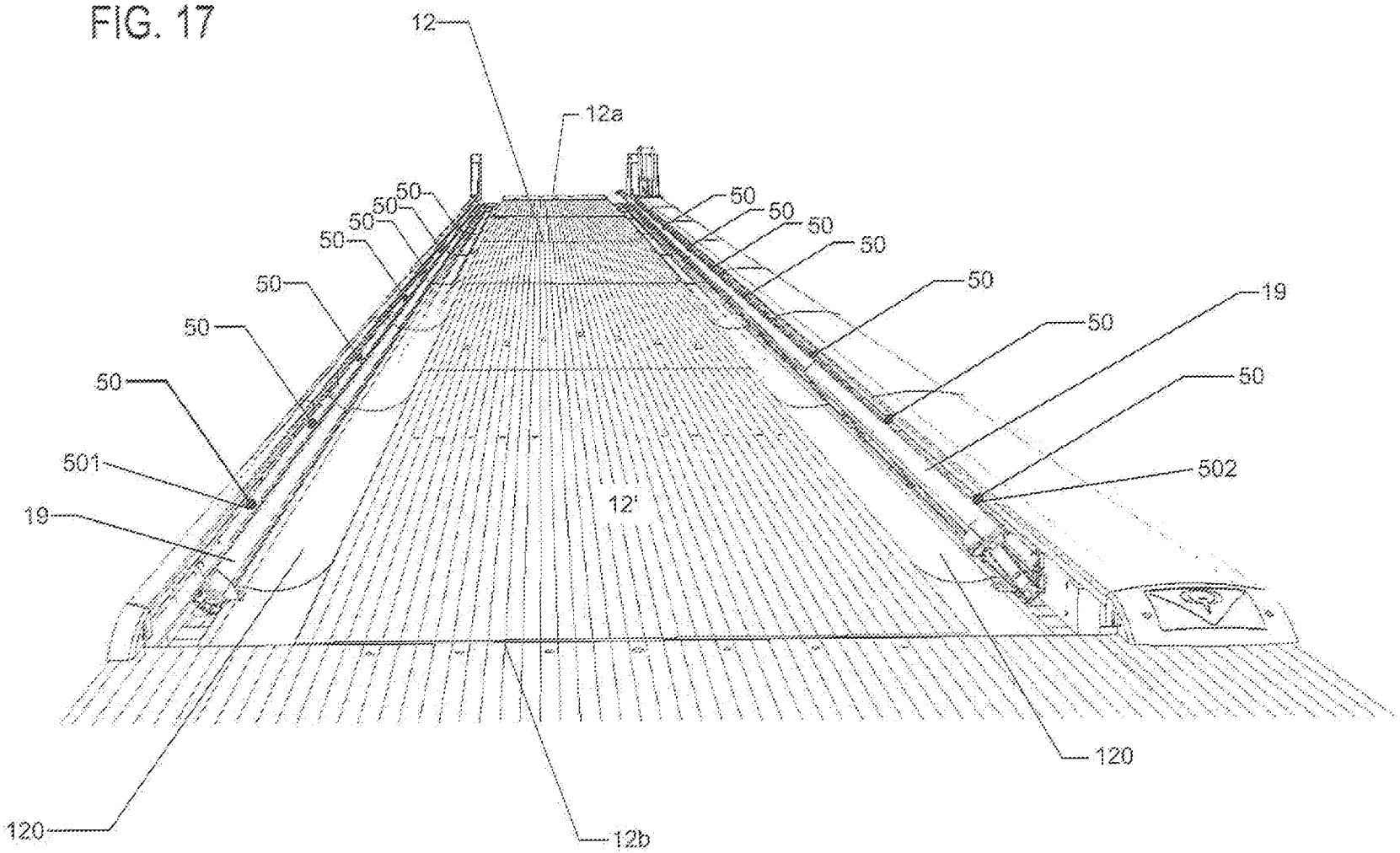
FIG. 17 is a schematic perspective view of a bowling lane of the preferred embodiment of the bowling centre according to this invention, showing in particular a preferred location of the lane sensors.

Advantageously, therefore, as may be inferred in particular from FIGS. 10 and 17, the detection system for detecting the bowl 13 as it rolls down the bowling lane comprises one or more detection sensors 50 which are located on the bowling lane 12 and which are designed to detect the bowl 13 as it rolls past the respective sensor 50.

Advantageously, a plurality of sensors 50 are provided for detecting the bowl 13 as it rolls down the bowling lane, the sensors 50 being located at predetermined longitudinal distances along the lane and, in particular, are longitudinally equispaced, as may be inferred in particular from FIG. 17.

More specifically, each sensor 50 for detecting the bowl 13 as it rolls down the bowling lane is in the form of a corresponding non-contact sensor, in particular in the form of an optical sensor, preferably of the infrared type.

Advantageously, each sensor 50 for detecting the bowl 13 as it rolls down the bowling lane comprises a first and a second sensor element or device 501, 502 across which a corresponding detecting radiation is transmitted, in particular in the form of a transmitter element 501 for transmitting the detecting radiation and a receiving element 502 for receiving the detecting radiation, the elements 501, 502 of the sensor 50 being situated on the opposite transverse sides of the lane 12.

Advantageously, as may be inferred in particular from FIG. 10, each sensor 50 for detecting the bowl 13 as it rolls down the bowling lane is positioned in such a way as to detect it in vertical proximity to or at the rolling surface 12' of the lane 12 so as to able to detect the presence of the bowl 13 resting on the rolling surface 12' of the lane 12.

That way, it is possible to detect whether the bowl is actually rolling on the lane or whether it is, as it were, "flying" along the lane without touching the rolling surface.

Advantageously, as may be inferred in particular from FIG. 10, the one or more sensors 50 for detecting the bowl 13 as it rolls down the bowling lane, in particular the respective first and second elements or devices 501, 502 of the sensors 50, are located at the respective lateral edge 12*e* of the lane 12.

Advantageously, as may be inferred in particular from FIG. 10, the one or more sensors 50 for detecting the bowl 13 as it rolls down the bowling lane, in particular the respective first and second elements or devices 501, 502 of the sensors 50, are located at the respective gutter 120, specifically on the side of this opposite to the corresponding bowling lane 12.

Advantageously, as may be inferred in particular from FIGS. 10 and 17, the one or more sensors 50 for detecting the bowl 13 as it rolls down the bowling lane, in particular the first and second elements or devices 501, 502 which define each of these sensors 50, are located at a fixed position relative to the bowling lane.

Advantageously, as may be inferred in particular from FIG. 2, the one or more bumper sensors 50 for detecting the bowl 13 as it rolls down the bowling lane are connected to a respective control processor 520, in particular to the processor which controls the lane lighting system 31, 30 and the respective bumper sensor 40.

In particular, therefore, the position/speed detection sensors 50 comprise an array made up of two or more optical infrared sensors with a transmitting source TX disposed on one side of the lane and a receiving source RX disposed on the corresponding opposite side of the lane. Each TX-RX pair detects the passage of the bowl in a specific zone of the lane.

In this preferred embodiment, multiple TX-RX pairs are placed along the lanes, at predetermined locations, as to be able to detect the passage, and calculate the speed and position, of the bowl on the lane. Precisely determining bowl speed and position has the purpose of allowing this data to be used as input values for bowling games with bumpers, as described above, and is a function of the total number of sensors mounted on the lane. More specifically, the position/speed sensors 50 are located on the lane in such a way as to detect the rolling motion of the bowl on the lane or whether a bowl is not rolling properly after being launched and is not touching the lane surface (as if it were flying over the lane).

The optical sensors used here have the advantage of working in low light conditions, in absence of other environmental lighting conditions, in presence of artificial fog on the lanes, with varying lighting condition and with any colour or external finish both of the bowl on the lane and of the lane surface itself. All these different conditions can affect and make unusable other means for detecting a bowl position on a lane, such as a camera, but they do not interfere with infrared optical sensors. This makes the use of infrared optical sensors particularly advantageous compared to alternative means for detecting the position of a bowl on a surface.

Advantageously, as may be inferred in particular from FIG. 9, each bumper 19 is actuated by a respective drive system 1192 which causes it to move between the raised position and the lowered position.

More specifically, as illustrated in FIG. 2, the drive system 1192 for raising and lowering the respective bumper 19 is driven by a respective control processor 520, specifically by the processor which controls the lane lighting system 31, 30 and which is connected to the respective bumper sensor 40 and to the lane sensors 50.

As may be inferred from FIG. 9, the drive system 1192 for raising and lowering the respective bumper 19 comprises an actuator, in particular a linear actuator 1190 for driving a corresponding lever 1191 which raises and lowers the bumper 19.

Advantageously, the drive system for raising and lowering the respective bumper comprises a system to prevent crushing an object or, in particular, a part of the human body when the bumper is lowered and/or when the bumper is raised.

The numeral 119 in FIG. 9, denotes an element, or damper, which is adapted to accumulate, in particular to accumulate elastically, the energy produced by the movement of the actuator 1190 when the latter meets an obstacle which prevents it from completing without resistance the normal action by which it lifts or lowers the bumper 19.

Preferably, the damping element 119 accumulates, in particular accumulates elastically, the energy produced by the movement of the actuator in each of both directions.

The damping element 119 is connected to the actuator 1190 on the side of the actuator opposite to the side where the bumper lift/lower lever 1191 is attached.

Figure 20A:
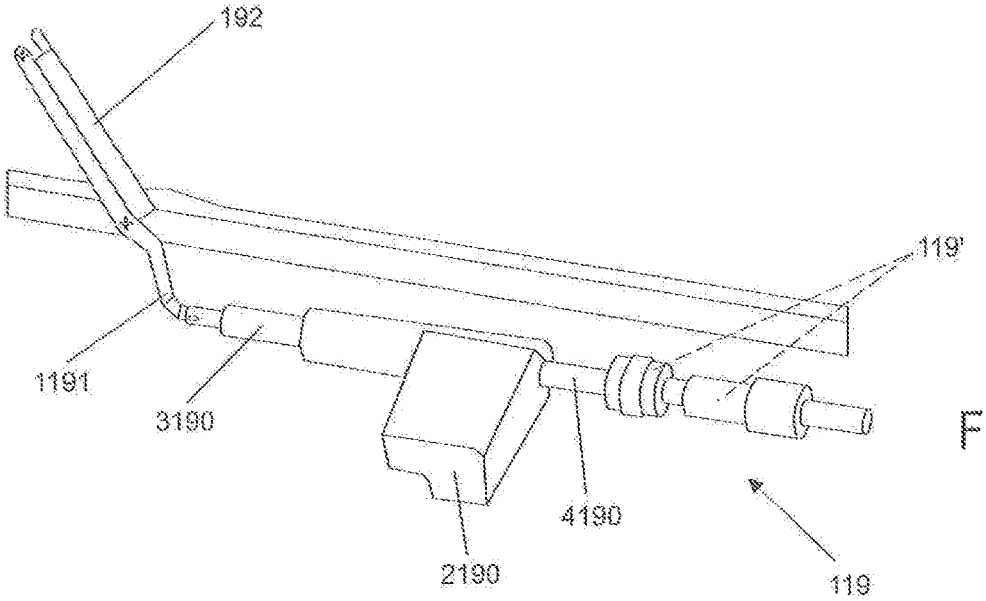
FIGS. 20A to 20C are perspective views showing different steps in the operation of the actuator which raises/lowers the bumper.
Figure 20B:
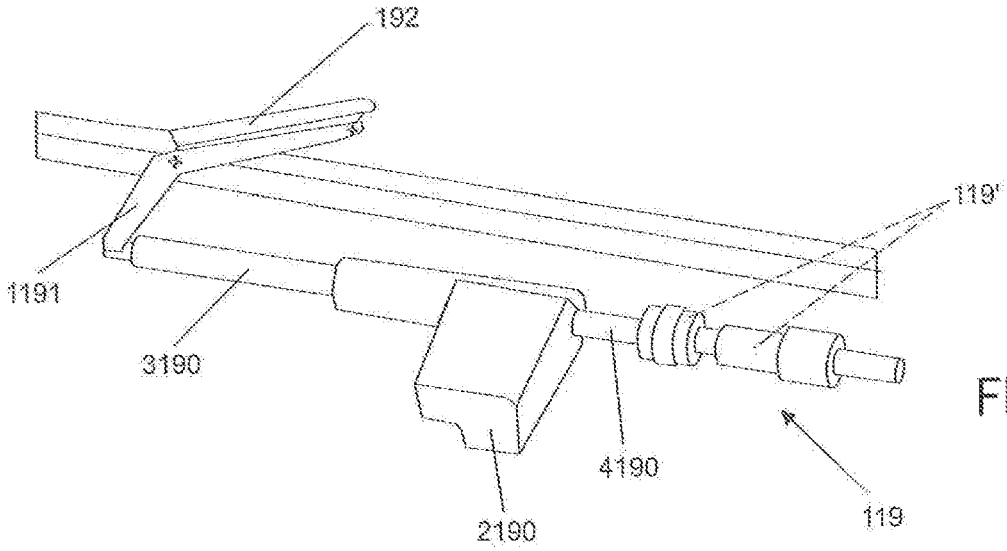
Figure 20C:
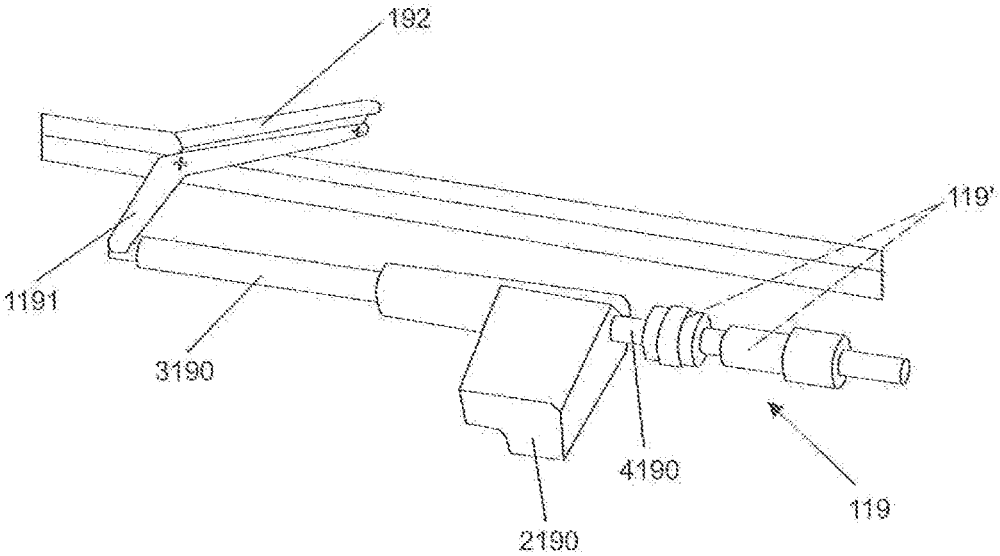

More specifically, as may be inferred from FIGS. 20A to 20C, the actuator 1190 has an actuator body 2190 from which there extends a rod 3190 which is axially extensible and retractable relative to the actuator body 2190 and which is connected, in particular directly connected, to the lever 1191 for raising and lowering the bumper 19. On the side of the actuator body 2190 opposite to that where the axially movable rod 3190 extends, there extends a rod 4190 which is fixed to the actuator body 2190 and which enters the damping device 119 and is connected to one or more corresponding elastic springs 119' which, when loaded, impart to the fixed rod 4190 an elastic action, specifically a two-way action, along the direction of the axis of the fixed rod 4190.

In practice, through corresponding movements imparted to elastic means inside the body of the element 119, the element 119 absorbs the energy, or the movement, specifically the linear energy or movement, produced by the actuator 1190 if it encounters resistance due to an interposed object, for example consisting of a part of the body of a player or operator while the bumper is being raised or lowered. That way, without interrupting the operation of the actuator, that is, the movement of the extensible/retractable rod 3190, crushing and injury to the person involved is prevented.

The element 119 thus constitutes an anti-crush safety device adapted to prevent the moving bumper from crushing parts of the human body. In particular, the anti-crush safety device 119 is adapted to elastically absorb the mechanical energy produced by the operation of the actuator 1190 when the movement of the actuator which raises or lowers the bumper meets a predetermined, excessive resistance.

Advantageously, therefore, as may be inferred in particular from FIG. 2, two or more systems chosen from among the lane lighting system, in particular the device 630 for controlling the lane lighting units 31, one or more bumper sensors 40 of the respective lane, one or more sensors 50 for detecting the bowl 13 as it rolls down the bowling lane, the drive system 1192 for raising and lowering the respective bumper 19 are connected to, and controlled by, a single control processor 520.

More specifically and preferably, as already stated and as may be well inferred from FIG. 2, a single processor 520 is connected to, and controls, the lane lighting system, in particular the device 630 for controlling the lane lighting units 31, the one or more bumper sensors 40 of the respective lane, the one or more sensors 50 for detecting the bowl 13 as it rolls down the bowling lane, and the drive system 1192 for raising and lowering the respective bumper 19.

Advantageously, as may be inferred in particular from FIG. 2, the control processor 520 for controlling the respective lane lighting system, in particular the respective device 630 for controlling the lane lighting units 31, and/or the one or more bumper sensors 40 of the respective lane, and/or the one or more sensors 50 for detecting the bowl 13 as it rolls down the bowling lane, and/or the drive system 1192 for raising and lowering the respective bumper 19, is connected to a local lane processor 105.

Advantageously, the control processor 520 for controlling the respective lane lighting system, in particular the respective device 630 for controlling the lane lighting units 31, and/or the one or more bumper sensors 40 of the respective lane, and/or the one or more sensors 50 for detecting the bowl 13 as it rolls down the bowling lane, and/or the drive system 1192 for raising and lowering the respective bumper 19, might also be connected to the main processor 101 of the bowling centre.

The bumper control system thus comprises a respective processor or server 520 having a respective bumper server CPU, specifically in this preferred embodiment, consisting of a Linux computer, provided with a set of inputs/outputs for interacting with the bumpers and the lane.

The bumper processor or server 520 receives information to be processed from the sensor subsystem 40, 50 and sends instructions to the control processor 520 of the bumper LEDs 30 in order to control the bumper LEDs 30 according to preset instructions and patterns or alternatively, according to instructions calculated in real-time based on a predefined algorithm.

The bumper server or processor 520 is also connected to the motor driver of the actuator 1190 which is connected to the metallic bumper structure and which can be activated to raise or lower the bumpers according to instructions from the bumper server or processor.

More specifically, the processor or processing unit 520 of the bumper server receives the signals from the speed/position sensors 50 and from the contact or bumper sensors 40 and is designed to determine if and where a bowl has touched the bumper rail or if and where the bowl has come sufficiently close to the bumper rail as to be considered as having effectively touched it.

The exact bowl position and contact point is determined by interpolating the two outputs coming from the position/speed sensors and from the contact/proximity sensors.

The sensors can be configured to detect if the impact point of a bowl falls within the predefined active bumper section. For example, the sensors can detect if the bowl has hit the bumper at a position excessively near to the players, which is at the beginning of a lane, configuring a foul situation.

As an alternative to the infrared optical sensors, as already described, to detect contact or proximity between the bowl and the bumper, electrical sensors can also be used. Electrical sensors use technologies able to detect the position of the touch in the section, based on the propagation time of a signal along two conductors that come into contact when the bowl hits the bumper or one of its sections. The electrical sensors might also be a micro switch tripped by the bending of the bumper or a vibration sensor able to pick up the vibration on the bumper or other sensors able to detect the result of the mechanical impact of the bowl on the bumper.

Advantageously, as may be inferred in particular from FIG. 6, each bumper 19 comprises a supporting element 190 for supporting the lighting devices or units and which is longitudinally elongate and defines the supporting surface 190' for supporting the lighting devices 30 divided into respective, individually controlled units 31. As illustrated, the support 190 comprises a core wall 190*a*, which defines the supporting face 190' of the lighting devices 30, and from this core there extend end wings 190*b*, 190*c* housing in between them the devices 30 for emitting light radiation.

In particular, the longitudinal element 19 is provided with a cavity which houses the lighting devices 30 or units 31.

Advantageously, as may be inferred more clearly from FIGS. 7 to 15, the bumper 19 comprises an element 191 for protecting and housing the lighting devices 30 or units 31, the protective element 191 being made of a transparent or semi-transparent material, preferably a plastic material. The element 191 for protecting and housing the lighting devices 30 or units 31 thus preferably also defines the upper bumper rail.

Advantageously, as may be inferred from the drawings, the bumper 19, in particular the longitudinal element or rail thereof 191, has a respective lateral impact surface or face 191', in particular extending perpendicularly or vertically, and which, in use, is adapted to be struck by the bowl 13.

Advantageously, as may be inferred from the drawings, the longitudinal element or rail 191 of the bumper 19 is supported by corresponding articulated or rocking arms 192 which move the element or rail 191 between a lowered, rest position, illustrated in FIG. 14, where the bumper 19 is at a level vertically below the surface 12' of the bowling lane 12 on which the bowl 13 rolls, and a raised working position for keeping the bowl on the lane 12, illustrated in FIG. 15, where the side bumper 19 protrudes upwards to a vertical level above the lane surface 12' on which the bowl 13 rolls.

Figure 14:
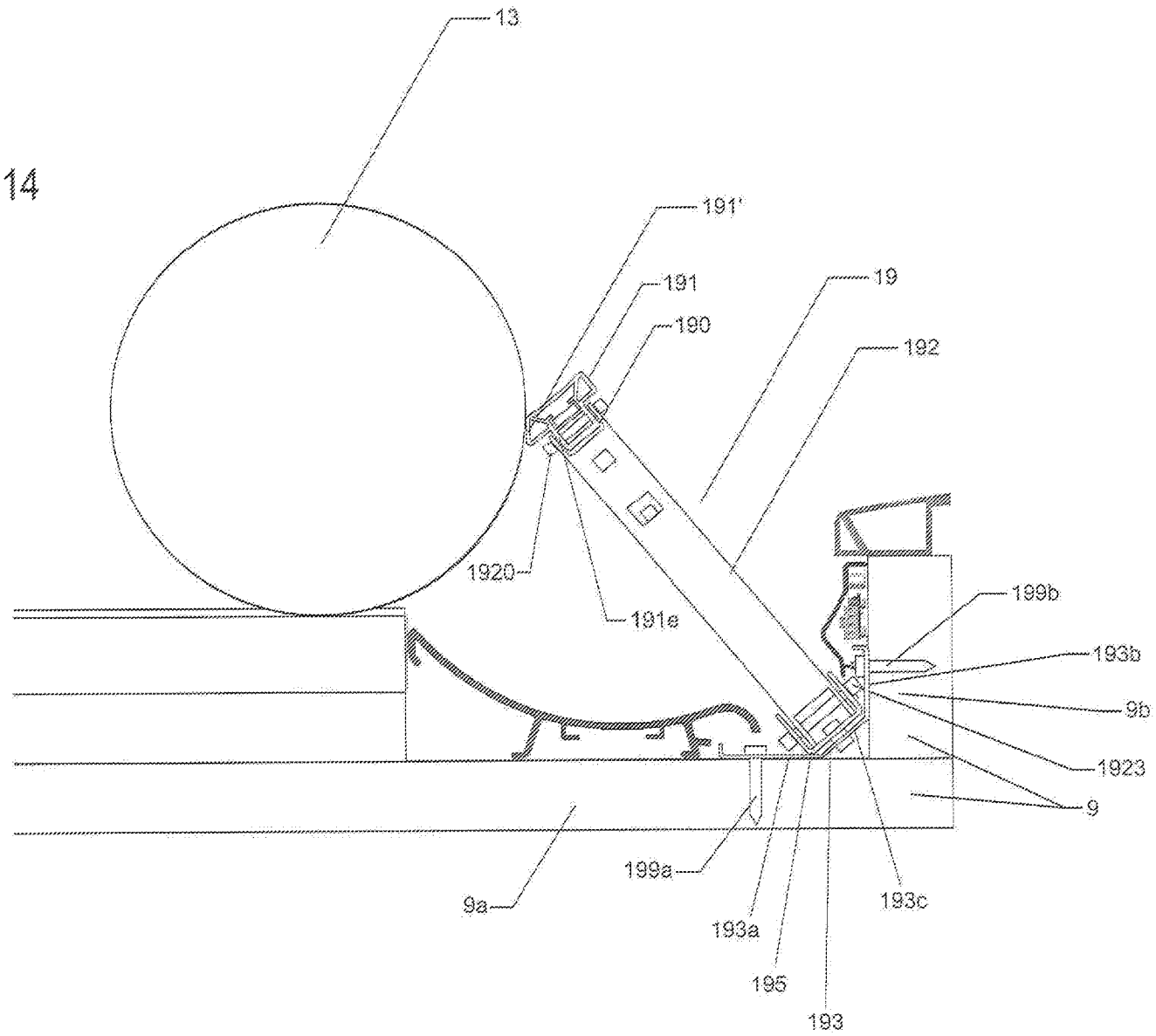
FIG. 14 is a schematic cross section of a detail of the gutter zone in the preferred embodiment of the bowling centre according to this invention.

Advantageously, as may be inferred in particular from FIG. 14, the articulated or rocking arms 192 for supporting the longitudinal element or rail 191 in the respective raised, working position are inclined at an angle to the bowl rolling surface 12' of the lane 12, being in particular inclined at an angle of between 40° and 60° and, preferably, at an angle of around 50°, to the surface 12' the bowl 13 rolls on.

More specifically, as illustrated, in the raised working condition of the bumper 19, the lane sensors 50 are arranged longitudinally between respective supporting arms 192 for supporting the respective longitudinal element 191 of the bumper 19.

More specifically, as illustrated, in the lowered rest condition of the bumper 19, the lane sensors 50 are disposed above the longitudinal element or rail 191 of the bumper 19.

Advantageously, as may be inferred from FIGS. 8 and 9, the bumper sensor 40, in particular the respective device thereof 401, 402, is mounted at a respective transverse protrusion 190*x*, extending towards the lane 12, of the longitudinal bumper element or rail 191, the respective protrusion 190*x* being in particular provided at the respective longitudinal end of the longitudinal element or rail 191 of the bumper 19.

Figure 15:
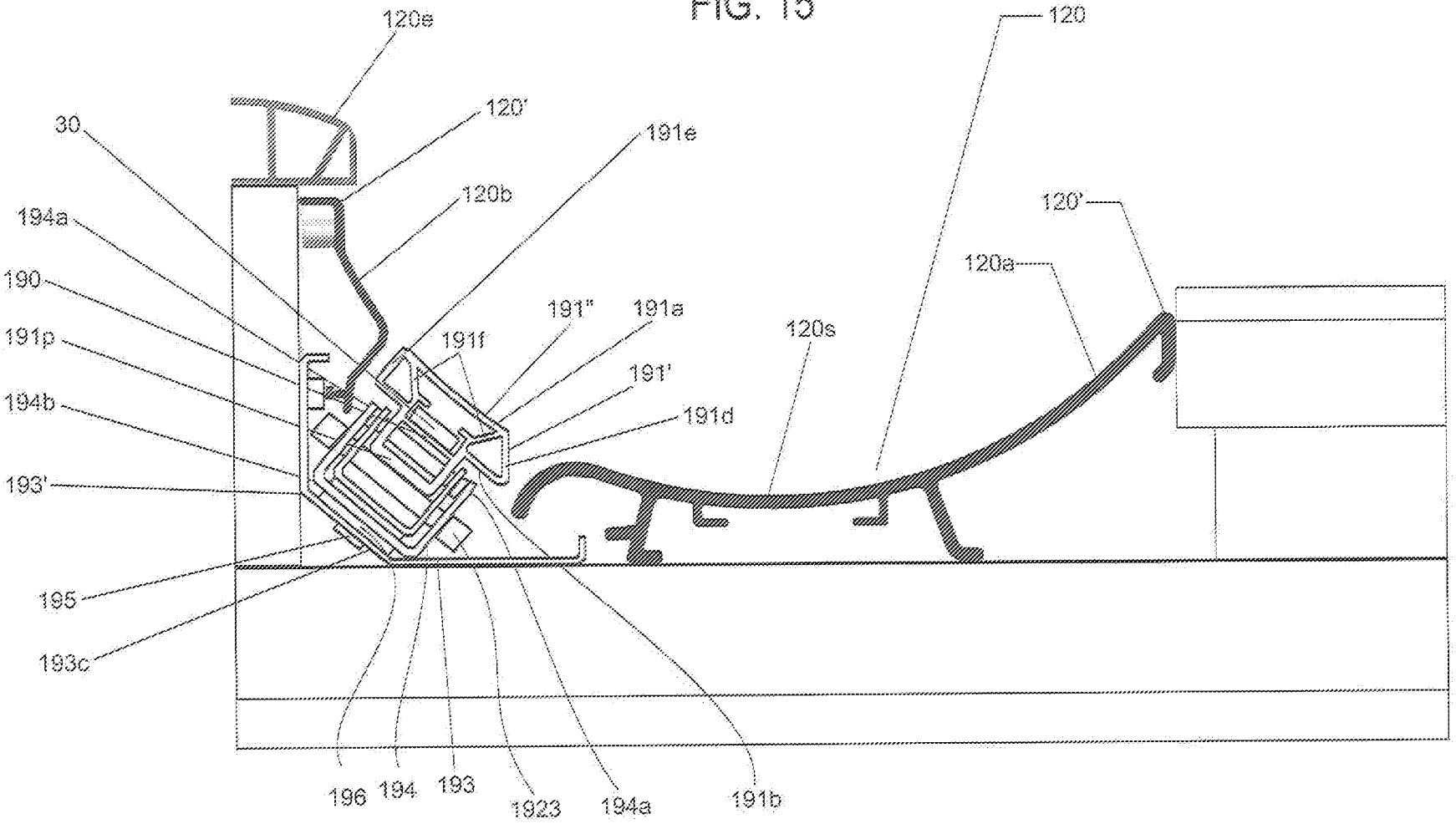
FIG. 15 is a schematic cross section of a detail of the gutter with the bumper in the lowered condition.

Advantageously, as may be inferred in particular from FIG. 15, the bumper 19 has a top surface 191" which, in the lowered position of the bumper 19, is located at the surface 120*s* of the gutter 120 which the bowl 13 drops out into, being in particular situated on the centre line opposite to the one that is adjacent to the lane 12 which the bowl 13 rolls on.

More specifically, in the lowered position of the bumper 19, the top surface 191" is disposed between a main portion 120*a* of the gutter 120, extending transversely for a stretch greater than half the transverse extension of the gutter 120 itself, and an end portion 120*b* which is situated on the side 120' of the gutter 120 opposite to the side 120" of the gutter 120 adjacent to the bowling lane 12 itself.

Advantageously, as may be inferred from the drawings, in particular FIG. 15, the lateral impact surface or face 191' adapted to be struck by the bowl 13 extends from the top surface 191" located at the surface 120*s* of the bowl gutter 120, in particular on the side of the top surface 191" facing towards the bowling lane 12.

Advantageously, as may be inferred from the drawings, in particular FIG. 15, the bumper 19 has at least one base element 193 for coupling the bumper 19 itself to the structure 9 which supports the gutter 120 and/or the bowling lane 12 itself.

Advantageously, as may be inferred in particular from FIG. 15, in the lowered rest position, the articulated or rocking arms 192 for supporting the longitudinal bumper element or rail 191 extend parallel to the longitudinal rail 191 itself.

Advantageously, as may be inferred in particular from FIG. 15, the respective articulated or rocking arm 192 for supporting the longitudinal element or rail 191 is connected by a respective rotation pin 1920, 1923 respectively to the upper longitudinal element or rail 191 of the bumper 19 and to the base element 193, in particular to the interposed elastic means 194 supported by the base element 193.

Advantageously, as may be inferred in particular from FIGS. 14 and 15, the base element 193 of the bumper 19 comprises a first portion 193*a*, in particular horizontal, for supporting and attaching, preferably through one or more screws 199*a*, to a corresponding surface, in particular horizontal, of the supporting structure 9*a* under the bowl gutter 120 and/or the bowling lane 12, and a second portion 193*b*, in particular vertical, for supporting and attaching, preferably through one or more screws 199*b*, to a corresponding lateral or perpendicular element 9*b* of the self-same supporting structure of the bowl gutter 120, the first and second portions 193*a*, 193*b* of the base element 193 of the bumper 19 being connected to each other by an oblique portion 193*c* which makes a respective angle to the horizontal and from which extends, in particular perpendicularly when the bumper 19 is in the raised position, the articulated, rocking arm 192 that supports the longitudinal element or rail 191 of the bumper 19 itself.

Figure 19:
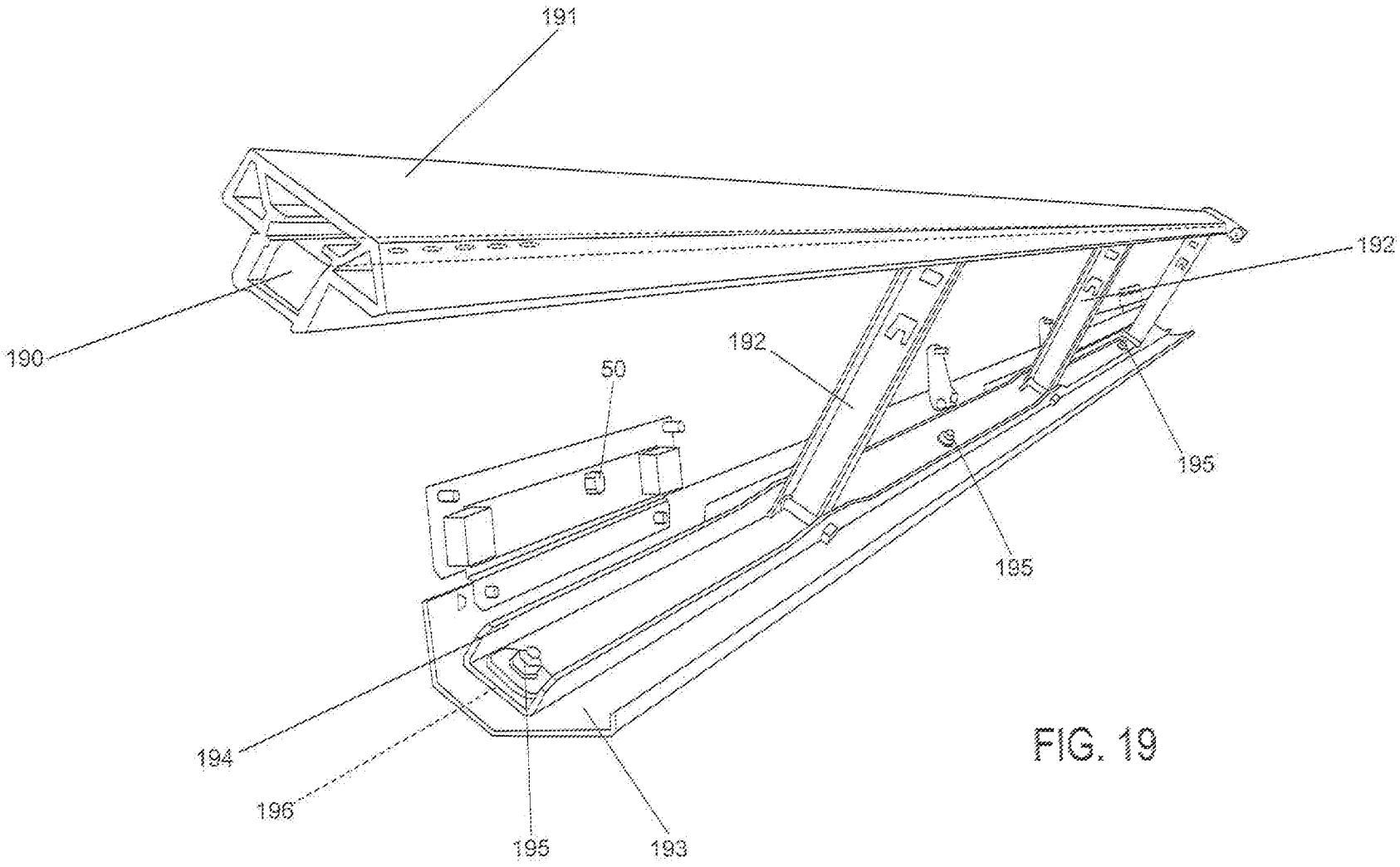
FIG. 19 is a perspective view of a bumper section, showing in particular the fastening of the elongate U-shaped element which mounts the bumper to the supporting structure fastening base.

As may be inferred from FIGS. 15 and 19, elastic means 194 are advantageously provided which are adapted to make the bumper 19 elastically compliant in such a way as to cause a bowl 13 which strikes the bumper bounce back towards the bowling lane 12.

Advantageously, the elastic means 194 are located below, or underneath, the arms 192 which raise and lower the bumper.

Advantageously, the elastic means are defined by a flexible, elongate element 194 to which the lower end of the respective arm 192 for raising and lowering the bumper is fixed, in particular in freely rotatable manner.

In practice, the flexible, elongate element 194 is adapted to make elastically compliant the coupling by which the lower end of the respective arm 192 for raising and lowering the bumper is fastened.

Advantageously, the flexible, elongate element 194 is interposed between the lower end of the respective arm 192 and the base element 193, the flexible, elongate element 194 being connected to the base element 193 and supported by the latter in freely bendable manner in the plane of extension of the respective arm 192.

As may be inferred from the drawings, the flexible, elongate element, or interposed element, 194 has the general shape of a U, whose side wings 194*a*, 194*a* are directed towards the arm 192 and are adapted to receive a corresponding pin 1923 for connecting freely rotatably the lower end of the arm 192.

The flexible, elongate element 194 is connected to the fixed, base coupling element 193 by corresponding fastening elements 195, in particular in the form of respective bolts, there being provided at these fastening elements 195 a respective spacer 196 which keeps the underside face of the flexible, elongate element 194 raised and perpendicularly spaced from the top face 193' of the base element 193, in particular from the top face of the oblique portion 193*c* thereof.

The spacer 196, specifically in the form of a respective metal washer, is provided with a suitable through hole for the fastening element 196, that is to say, for the respective bolt shank, and raises the core 194*b* of the flexible, elongate element 194 relative to the opposing surface 193' of the base element 193.

As may be well inferred from FIG. 19, the connection between the respective arm 192 and the flexible, elongate element 194 is spaced, in particular longitudinally spaced, from the coupling 195 by which the flexible, elongate element 194 is fixed to the base coupling element 193.

Preferably, the flexible, elongate element 194, the fastening elements 195 and the spacer 196 are made of metallic material.

As may be inferred from the drawings, the flexible, elongate element 194 is adapted to support a plurality of arms 192 for raising and lowering the bumper 19.

Advantageously, as may be inferred in particular from FIG. 15, the upper rail 191 of the bumper 19 defining the element for protecting and housing the lighting devices 30 is in the form of a shaped plastic profile.

As may be inferred in particular from FIG. 15, the shaped upper profile 191 has a respective top wall 191*a* defining the top surface 191" of the bumper 19 and a bottom wall 191*b* from which extends a bottom portion 191*p* for engagement and connection to respective rocking arms 192, the top and bottom walls 191*a*, 191*b* being connected to each other by opposite lateral end walls 191*e*, 191*d*, one of which defines the bowl engagement surface 191' and a plurality of corresponding, connecting and stiffening partitions 191*f*. More specifically, a first and a second intermediate partition 191*f*, 191*f* are provided which are transversely divergent towards the top wall 191*a* of the profile, to allow the corresponding lighting device to light the entire top wall 191*a* of the profile, or at least a large transverse portion thereof.

Advantageously, each bumper 19 is composed of, or subdivided into, a plurality of bumper sections or portions which are longitudinally aligned with each other.

In this embodiment, the longitudinally aligned bumper sections or portions are attached to each other and hence driven, in particular, raised or lowered, simultaneously.

Advantageously, the longitudinally aligned bumper sections or portions might, however, also be driven, in particular, raised or lowered, or lit, independently of each other.

Also advantageously, the top impact face or surface 191' adapted to be struck by the bowl 13 is transversely spaced from the corresponding lateral edge 12*e* of the bowling lane 12.

In particular, advantageously, the respective sensor 40 which detects bowl proximity to, or impact with, the respective bumper 19 and which is preferably mounted on the bumper 19 itself, especially when the bumper 19 is in the raised condition, is positioned perpendicularly above the bowl gutter 120, that is, it is transversely spaced from the corresponding lateral edge 12*e* of the lane.

That way, it is possible to prevent unwanted reflections on the lane, which would interfere with or make ineffective any signal representing proximity or contact of the bowl relative to the bumper.

Advantageously, the rocking arms 192 of the bumper 19 are equispaced: the spacing is for example, 813 mm.

Also advantageously, as will become clearer as this description continues, the bumper has zones with a stiffened structure to be able to withstand excessively strong impacts with the bowl 13. The stiffened zones are located, in particular, in the vicinity of the bowl throwing position.

Advantageously, as will become clearer as this description continues, in the vicinity of the bowl 13 throwing position 12*b*, the bumper 19 comprises respective reinforcement means.

This prevents damage to the bumper caused by bad throws.

Advantageously, as may be inferred in particular from FIG. 9, the reinforcement means of the bumper 19 comprise an additional rocking arm 192', in particular provided at the zone where the bumper 19 is connected to the drive system for raising and lowering the bumper 19.

Advantageously, as may be inferred in particular from FIG. 9 again, the reinforcement means of the bumper 19 comprise an elongate element 194 for freely rotatably supporting the bumper arm 192 which is permanently attached, in particular welded, to the base 193 for coupling to the structure 9 which supports the gutter and/or the bowling lane 12 itself.

Advantageously, although not illustrated in detail in the drawings, the reinforcement means of the bumper 19 comprise an additional reinforcement rail, preferably metallic, which extends longitudinally, in particular at, and attached to, the upper rail 191 of the bumper 19.

In practice, this bowling centre comprises bumpers 19 which extend along the sides of the lanes 12 and which, when activated, allow playing without the risk of the bowl falling into the gutter 120.

As stated, each side bumper 19 may consist of a single element or a plurality of elements covering a respective longitudinal stretch of the respective side of the lane. Thus, each bumper 19 may be a single structure or it may be made up of different segments physically joined tom each other and operating as one for the purposes of the game.

Advantageously, the bumpers 19 are robust enough to withstand intentional high-powered hits from bowls thrown by adult players.

The bumper structure has different levels of robustness to accommodate the different impact forces which a bowl thrown against it can apply. In effect, the section nearer to the players' position is made stronger to withstand direct hits that are more probable if a bowl hits the bumper in its initial portion. The remaining portion of the bumper rail is made less strong, but strong enough to withstand bowl hits which are of lower strength because they occur further away from the point where the bowler throws the bowl.

As already stated, if the bumpers are made up of one or more sections, each section can be controlled (raised, lowered, moved, highlighted by lights) independently of the others, even if, as already stated, the longitudinally aligned bumper sections or portions are preferably attached to each other and hence driven, in particular, raised or lowered, simultaneously.

Advantageously, as illustrated and stated, the structure of the bumpers 19 is housed in the structure of a gutter 120. The gutter 120 is thus made up of a main part 120*a* and a secondary part 120*b*. The main part 120*a* extends from the edge of the lane 12 to the point where the semi-transparent plastic bumper portion or wall 191*a* is located. The secondary part 120*b* begins on the side opposite the plastic bumper portion or wall 191*a* and ends against the wooden structure of the lane capping.

Advantageously, when the bumper 19 is in the lowered condition, the top surface of the bumper is at a position which cannot be reached by the bowl 13 rolling in the gutter, the bowl in particular engaging the outer end edge 120*e* of the gutter 120 and the opposite zone 120*a* of the gutter.

This protects the gutter 19 and, in particular, the lighting devices 30 mounted thereon.

As stated and illustrated, the bumper 19 comprises a preferably metallic structure or framework which allows the bumper 19 to be raised or lowered according to the desired state.

As stated and illustrated, the bumper 19 also comprises a plastic body 191 which defines the portion that comes into contact with the bowl and which is used to house the LED devices of the LED lighting system.

More specifically, as stated and illustrated, the plastic body has a shape that allows it to sit flush with the concave surface of the gutter when the bumper is in lowered/retracted position.

More specifically, the plastic body or element 191 has a shape and elasticity such as to allow the bowl striking one side of it to bounce back correctly towards the lane.

As may be inferred, the plastic body or element 191 defines a cavity which extends longitudinally and which contains the support 190 that mounts the strip of LED devices 30 forming part of the lighting subsystem. In practice, during assembly of the bumper system, the support 190 that mounts the lighting devices or units is inserted longitudinally into the rail 191.

Advantageously, as stated, the plastic body or element 190 is transparent in order to let the players see the light emitted by the LED strip 30 and, at the same time, opaque enough to diffuse the light emitted and thus mask the punctiform nature of the light. The result is a homogeneous light effect visible to players.

As already stated and illustrated, the bumper metal structure thus comprises a shaped base element or bracket 193 extending parallel to the lane 12 and attached to the wooden lane foundation by a plurality of screws: a first set of screws 199*a* to join the base bracket to the wooden foundation of the lane in a plane parallel to the lane itself and a second set of screws 199*b* to join the base bracket to the wooded portion of the lane foundations perpendicularly to the lane plane. Thus, the screws are set perpendicularly to each other, greatly improving the joining robustness between the base bracket and the lane foundation. This enhances the bumper structure resistance to bowl hits, by having the shock of the bowl hit discharged on the lane foundations in two separate directions.

As stated, the upper plastic bumper rail is connected to the base bracket by means of a set of rocking connecting arms 192; the arms 192 are made of metallic material.

As stated, the rocking arms 192 can be moved by a motor, which drives an actuator, specifically a linear actuator 1190 which is in turn connected to one or more of the bumper elements or sections. The actuator, specifically the linear actuator 1190, allows the rocking arms and the upper bumper rail 191 to be raised and lowered along an arc.

Preferably, the bumper is composed of several separate or independent sections, each comprising a base bracket 193, a fixed number of rocking arms 192 and the upper rail 191, which can be supplied to the final customer in pre-assembled form and which, during assembly, can be joined together to form a single solid metal bumper extending along the length of the lane.

Advantageously, the rocking arms 192 of the bumper 19 are equispaced: the spacing between the arms is, for example, 813 mm.

Left-hand and right-hand bumpers share the same structural properties and are symmetrical about the longitudinal centre line of the lane.

The physical and functional characteristics of the bumper make the bumper resilient, or elastic, and capable of withstanding continuous use by bowlers of all ages.

Compared to traditional bumpers, the bumpers described in this application allow players to use a wider portion of the lane. In effect, the current prevalent way of having bumpers on a lane is to mount them aligned with the lane edges (between the lane plane and the gutter). The bowl is thus forced to remain fully within the lane during play. Instead, with the bumpers described herein, which are designed to be raised at an angle to the gutter, the bumper portion of the structure does not correspond to the edge of the lane, but is spaced from the edge horizontally in such a way as to prevent the bowl from falling into the gutter and at the same time making the useful lane width wider than in the case of traditional bumpers.

Advantageously, therefore, the bumpers can become active and interactive parts of the bowling gameplay.

Advantageously, in this preferred embodiment, the lane bumpers lose their current role of being just containing borders determining if the player's bowl remains in the game or not, but they are now an active part of the game, contributing to the scoring or other game outcome.

This is done through the use of detection or sensor systems and/or the lighting system like those described herein by way of example.

For example, the bowler might be asked to hit the bumper or one of its portions to achieve a better score, based on detections performed by a sensor and communicated to the bumper server 520. Alternatively, the bowler might be asked not to hit the bumpers, or one or more of its sections, to avoid incurring a penalty.

In some embodiments, standard tenpin bowling can still be played even if the bumpers are raised, calculating the score in the same way as in standard bowling when a bowl hits the bumper. Although this is not a USBC/BPAA/PBA approved rule, a scheme of this kind might be implemented in informal competitions based on the rules of standard 10-pin bowling.

In a preferred embodiment such as the one described, the bumper might be provided with sensors to detect whether the bowl hits the entire bumper or one or more parts of the bumper. In a more specific, preferred embodiment, the bumper might be provided with sensors to detect the absolute position of a bowl which hits the entire bumper or one or more parts of the bumper.

The plurality of sensors on the plurality of bumpers mounted on the plurality of bowling lanes make up a detection system capable of providing a set of inputs directly, or further processed through a dedicated processing device, to a plurality of pinspotting machines, to the scoring system, to the management system, or to any other system or device such as special effects devices or a special effects management system as described herein. All these systems can be either physically present at the bowling centre or located remotely, as a management system, operating off the premises such as a cloud-based system.

In some embodiments, the detection system can be connected to an automated scoring system to have the score calculated and the game run automatically according to the signals provided by the sensors. In addition, the system which highlights which bumper or bumper section to hit can be connected to an automated scoring system.

In the case of a bowling lane equipped with sensors, which detect the bowl hits along the lane border, such a lane might be built without gutters, bumpers or foul line detector, and be still used to play all the above-mentioned games, including a standard tenpin game. In this case, the following examples might be implemented by at least some of the systems and processes described herein.

The sensors would provide the pinspotting machine and/or the scoring system with the information about the bowl touching the lane borders, detecting the cases where the bowl would have fallen in the gutter if the lane were built in a standard way with gutters.

The scoring system would manage the whole game as previously described, including the case of a game played in standard tenpin bowling emulation mode. In this case, the bowl touching the lane bumper would be interpreted by the system as a bowl falling into the gutter.

More specifically, the contact or proximity sensors would provide the pinspotting machine and/or the score system with the information about the bowl touching the lane borders, detecting the cases where the bowl would have fallen into the gutter if the lane were built in a standard way with gutters.

The scoring system would thus manage the whole game as previously described, including the case of a game played in standard tenpin bowling emulation mode. In this case, the bowl touching the lane bumper would be interpreted as the bowl falling into the gutter and the scoring system, in conjunction with the machine, could manage the information to replicate the behaviour of a lane and a game played according to the standard bowling rules, even in the case of the bumper being in the raised position.

The bumpers may have one or more independent sensors along their length. The sensors can detect the point where the bowl touches the bumper.

The contact information is relayed to the dedicated bumper control system, to the scoring system or to the management system as described herein. A number of sensors variable from one to many might be used, depending on the sensor technology adopted, and in any case a number of sensors sufficient to divide the bumpers into zones of variable lengths, from small (e.g., a centimetre or less) to larger (e.g., the entire lane). The focus of these contact/proximity sensors is to detect the bowl touching the bumper rails as described above.

This embodiment, as stated, comprises a plurality of lighting devices, specifically RGB LED lights, running the length of the bumper, controllable individually, or preferably in pairs, and connected to the bumper control server 520, and indirectly to the score and management systems, as described herein.

The lights can be used as target signals, with similar or different colours indicating where to hit or not hit along the bumper length. Lit locations might correspond to zones that have been predefined as zones to be hit or not hit by a bowl thrown by a player, and where the corresponding sensors detect each point where the bowl has touched the bumper.

This would allow creating games based on which bumper section to hit, with related bonuses or penalties according to the behaviour of the bowl.

The lighting provided by the RGB LED lights mounted on the upper bumper rails can be used in conjunction with bowl position on the lane (e.g. the lights are controlled in conjunction with the sensors and follow the bowl as it rolls towards the pins).

In addition, the lighting devices can have a full range of colours, used to provide information indicating mistakes made by the bowler in throwing the bowl. For example, if it is detected that the bowl has been thrown with excessive force, with the intended or unintended result of damaging the bumpers, all the lights could start flashing in red to warn the bowler of the incorrect behaviour. The same information might be used by the scoring system to assign a penalty. The lights can vary in colour to identify and indicate the point of contact between the bowl and the bumper. In this preferred embodiment, the lighting devices are built into the bumper, mounted thereon. Alternatively, they might also be mounted on the lane capping or on RGB projectors mounted at appropriate positions, for example on the ceiling.

The bumper movement is controlled by actuators. For example, each bumper section might also be controlled by dedicated actuators. The actuators are connected to, and managed by, an actuator control unit, which in this specific case, is the bumper control server unit.

In other embodiments, the speed/position sensors can detect the position of the bowl on the lane even if it has not touched the bumpers. For example, "bowl position" is detected by non-contact sensors that can sense the position of the bowl as it rolls down the lane, even if it does not touch the bumpers. The position of the bowl is calculated by an optical sensor when the bowl breaks a respective light beam. Consequently, in the application implemented, the position of the bowl is known even if the bowl does not touch the bumper. This allows using bowl position to enhance the light effects produced by the lighting system. Specifically, in some embodiments, the light effects can "follow" the bowl as it rolls down the lane. In addition, if the bowl touches the bumper, the "bumper-impact" signal from the "bowl position" sensor allows the score system to determine whether the bowl has hit the correct zone or not.

As in all of the other embodiments described, each speed/position sensor sends a signal to the electronic control system, which then uses the signals to detect the position of the bowl as it rolls down the bowling lane.

The electronic control system then provides a signal to the lighting system to switch on the lights in various predetermined modes. The predetermined modes may be, for example: following the bowl, dividing the bumper into sections or highlighting another zone of the bowling lane.

In addition, or alternatively, bowl-bumper contact can be associated with additional penalties or rewards independent of the game score, such as inputs for a game bonus in a redemption system. For example, rewards or penalties can be associated with single detections, sequences of detections, detections or detection sequences in predetermined bumper zones (e.g. the player must hit the bumper only in the green-lit area, without letting the bowl bounce and hit the red-lit area of the bumper on the opposite side. The bumper zone involved in such games might be determined by the scoring or management system as part of predefined games or routines, or might be preselected by the players, or might be determined by a combination of both (for example, the player chooses a particularly difficult bumper zone to hit because if the player succeeds the player will obtain a higher score). The bumper zones might be fixed and stable the whole time the player is allowed to throw a ball, or might change according to a fixed pattern or randomly, thus increasing game difficulty.

A scoring system is not essential for a bowling centre using the new game concept. The system might work in a standalone mode, with sensors and lights connected to a non-scoring processing unit, receiving inputs from the sensors, processing them according to a predefined set of instructions (either preset by the manufacturer or customizable by the customer) and accordingly sending out output signals. In a setup of this kind, the bumper lighting devices react to bumper sensor detections, with or without significance in the context of the game. The game might also be played without any automatic system in place, with the bowlers playing on a lane with raised bumpers, using the bumpers as an active part of the game, but keeping their score manually according to predefined game rules involving bumpers as an active game element (for example, if the player scores a strike after hitting the central section of the right-hand bumper, then the strike counts twice).

Figure 3:
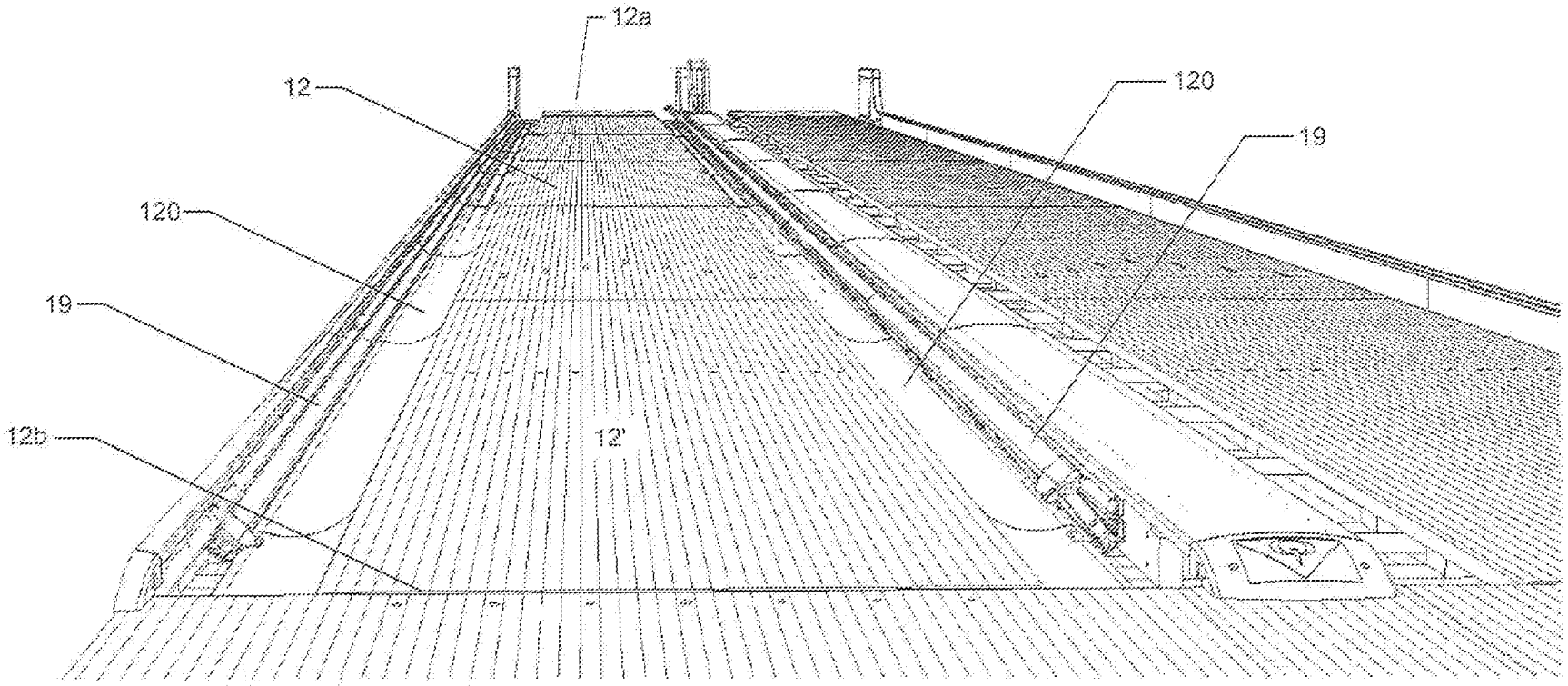
FIG. 3 is a schematic perspective view of a bowling lane of the preferred embodiment of the bowling centre according to this invention.

In further embodiments, the processing unit of the detection system and/or the bumper lighting system described herein, or the individual sensors and individual lighting devices with no interface, might be connected to the scoring system, allowing the two systems to fully interact with each other, with the inputs coming from the sensors accounted for by the system and treated as other scoring inputs, that combined with other scoring events can determine the score or the outcome of a game managed by the system. The score system might then instruct the light-sensor processing unit, or directly the lights, to act according to predetermined or real-time processed instructions to obtain specific light effects on the lanes. The lane lighting can be made to act together with other special effects present at the bowling centre, so as to obtain coordinated light effects on the lanes or throughout the bowling centre. The scoring system can be represented by any of the computing devices shown in FIGS. 2 and 3, for example.

In this bowling centre, the position of the bowl can be placed in relation to the lighting, in particular the lighting from the bumpers. For example, the information regarding the bowl position determined by detecting the bowl as it moves past the sensors can be used by calculating the speed of the bowl and interpolating the information in such a way as to obtain an estimated bowl position to inform the electronic system that controls the bumper lighting system so as to create a tracking light effect in the wake of the bowl as rolls down the lane.

Advantageously, therefore, the electronic control system 100 of the bowling centre determines the position of the bowl 13, in particular calculates or estimates the position of the bowl as it rolls down the bowling lane 12.

More specifically, advantageously, the electronic control system 100 of the bowling centre, in particular the processor 520 which is connected to the means 40, 50 for detecting the bowl as it rolls down the lane, calculates or estimates the position of the bowl as it rolls down the bowling lane, based on the signals received from the bowl detection system, in particular from the lane sensors 50 and/or from the bumper sensors 40, in particular determining the position of the bowl rolling past respective sensors 50 and calculating the speed of the bowl between respective sensors 50.

Advantageously, therefore, the electronic control system 100 of the bowling centre, in particular the processor 520 which controls the lane lighting system 31, 30, controls the lighting system, in particular each lighting unit or groups of lighting units 31 in such a way as to follow the bowl 13 as it rolls down the bowling lane 12.

More specifically, advantageously, the electronic control system 100 of the bowling centre, in particular the processor 520 which is connected to the means 40, 50 for detecting the bowl as it rolls down the lane and which controls the lane lighting system, calculates or estimates the position of the bowl as it rolls down the bowling lane, based on the signals received from the bowl detection system, in particular from the lane sensors 50 and/or from the bumper sensors 40, and controls the lighting system, in particular each lighting unit or groups of lighting units 31 in such a way as to follow the bowl 13 as it rolls down the bowling lane 12.

Advantageously, therefore, the electronic control system 100 of the bowling centre, in particular the scoring program, when it receives a corresponding bumper impact or proximity signal from the respective bumper sensor 40, considers the bowl 13 as having fallen into the gutter and calculates the game score accordingly and, if necessary, issues commands to perform corresponding actions such as, for example, the lowering of the full set of pins if contact with the bumper 19 occurred during the player's first throw.

The equipment, systems and methods herein described can be used to create an innovative game format based on bowling, providing the basis for converting, in a non-permanent way, existing bowling lanes in order to extend the appeal of bowling to people looking to have fun in a safe environment either in a competitive or in a non-competitive fashion.

A further advantage of this gutter and bumper system is that it can be adapted to existing bowling lanes and can be easily installed and used in bowling centres that wish to update their facilities to be able to offer this novel game system.

The invention described above is susceptible of industrial application. It would be obvious to one skilled in the art that several changes and modifications can be made to the invention without departing from the spirit and scope of the invention, described in depth above. Also, further preferred embodiments of the invention comprising one or more of the features described herein can easily be imagined. It will also be understood that all the details of the invention may be replaced by technically equivalent elements.

The invention claimed is:

1. A bowling center, comprising:

at least one bowling lane along which a ball is rolled and having a rolling surface at one end of which are positioned pins to be knocked down and at an opposite, longitudinal end of which is located a bowler's bay from where the ball is thrown, the at least one lane comprising a side bumper running along each side of the bowling lane and movable between a lowered position which allows the ball to roll freely off the bowling lane into a gutter which channels the ball out of the bowling lane, and a raised position for keeping the ball on the bowling lane;

an electronic control system configured to manage the at least one bowling lane to implement a scoring program which calculates a score of a game played on the at least one bowling lane;

a detection system connected to the electronic control system, the detection system comprising optical sensors along the bowling lane and which is configured to detect a position of the ball along the bowling lane at a location which passes the optical sensors by the ball breaking a respective light beam of the optical sensors and the optical sensors sending a signal to the electronic control system, which the electronic control system uses the signals to detect the position of the ball as it rolls down the bowling lane; and a lighting system comprising a plurality of lighting units mounted on each side bumper, the lighting system being connected to the electronic control system which is configured to individually control each lighting unit to light respective zones of each bumper in a differentiated manner based on the detected position of the ball.

2. The bowling center according claim 1, wherein each lighting unit controlled by the electronic control system of the bowling center comprises, for each bumper, at least one lighting device extending along a full length of the corresponding bumper.

3. The bowling center according to claim 1, wherein the electronic control system controls each lighting unit to light corresponding zones of the corresponding bumper selectively and variably.

4. The bowling center according to claim 1, wherein the electronic control system controls each lighting unit to emit a different color light or no light by each lighting unit.

5. The bowling center according to claim 1, wherein the electronic control system is configured to control each lighting unit, in respective zones of each bumper.

6. The bowling center according to claim 1, wherein the respective lighting units are mounted along an upper zone of the corresponding bumper and above a corresponding face of the bumper which are directed at least partly upwards of the bumper which is inclined at an angle to a horizontal and directed towards the bowling lane the bumper is associated with.

7. The bowling center according to claim 1, wherein each lighting unit is controlled by a corresponding control device connected to the electronic control system.

8. The bowling centre according to claim 1, wherein the detection system comprises a plurality of sensors which detect ball proximity to, the corresponding bumper.

9. The bowling center according to claim 8, wherein the plurality of sensors are mounted on each bumper and are operational when the bumper is in the raised condition.

10. The bowling center according to claim 8, wherein a corresponding sensor of the plurality of sensors is mounted on a face of the bumper which is designed to be struck by the bowl, each sensor comprising an optical sensor.

11. The bowling center according to claim 1, further comprising a contact sensor located on a face of the bumper which is designed to be struck by the ball.

12. The bowling center according to claim 8, wherein each sensor is connected to a corresponding control processor.

13. The bowling centre according to claim 1, wherein the detection system for detecting the bowl as it rolls down the bowling lane is configured to determine a speed of the bowl rolling down the bowling lane based on the signals received from the optical sensors and signals from bumper sensors as the ball passes the location of the optical sensors and contacts the bumper sensors.

14. The bowling center according to claim 1, wherein the detection system for detecting the ball as it rolls down the bowling lane comprises a plurality of detection sensors which are located on the bowling lane at predetermined distances and which are designed to detect the ball as it rolls past each detection sensor such that the lighting units are turned on to follow the ball as it rolls down the bowling lane in response to signals received from the detection system.

15. The bowling center according to claim 1, wherein each bumper comprises a corresponding drive system capable of moving the bumper between the raised position and the lowered position.

16. The bowling center according claim 1, wherein each bumper comprises an element or rail for mounting the lighting devices.

17. The bowling center according to claim 1, wherein the bumper comprises a protective element which protects and houses the lighting devices, the protective element being made of a transparent or semi-transparent material.

18. The bowling center according to claim 16, wherein the element or rail is a longitudinal element or rail which has a respective lateral surface or face which extends perpendicularly or vertically, in use, for impact with the bowl, the longitudinal element or rail of the corresponding bumper being supported by corresponding articulated or rocking arms, designed to move the longitudinal element or rail between a lowered, rest position and a raised position for keeping the ball on the lane.

19. The bowling center according to claim 18, wherein the articulated or rocking arms which support the longitudinal element or rail in the respective raised, working position are inclined at an angle to the ball rolling surface of the bowling lane at an angle of between 40° and 60°.

20. The bowling center according to claim 1, wherein each bumper has a top surface which, in the lowered position of the bumper, is located at the surface of the gutter which the ball drops out into, which is situated on a centre line opposite to the one that is adjacent to the lane which the ball rolls on.

21. The bowling center according to claim 16, wherein each bumper has an articulated, rocking arm which supports the element or rail and connected by a respective rotation pin respectively to an upper element or rail of the bumper and to a base element.

22. The bowling center according to claim 1, further comprising an elastic element making the bumper elastically compliant to cause the ball which strikes the bumper to bounce back towards the bowling lane.

23. The bowling center according claim 2, wherein each lighting is a LED.

24. The bowling center according to claim 23, wherein the LED is a red green blue (RGB) multicolor LED and a plurality of the LEDs extend along a full length of the corresponding bumper.

25. The bowling center according to claim 4, wherein the type of lighting is a color of the lights emitted by each lighting unit.

26. The bowling center according to claim 6, wherein the respective lighting units are directed on a face of the bumper.

27. The bowling center according to claim 10, wherein each bumper sensor is an infrared sensor.

28. The bowling center according to claim 17, wherein the element for housing and protecting the lighting devices defines a corresponding upper bumper rail.

29. The bowling center according to claim 19, wherein the articulated or rocking arms are inclined at an angle of around 50° to the rolling surface the ball rolls on.

30. The bowling center according claim 1, wherein when the side bumper is moved into the lowered position, the optical sensors are hidden from view.

31. The bowling center according claim 1, wherein the detection system is configured to determine when a ball is flying or rolling on the bowling lane.

32. The bowling center according claim 31, wherein the detection system is configured to detect a rolling motion of the ball on the bowling lane and whether the ball is not touching a lane surface of the bowling lane after being launched.

33. The bowling center according claim 30, wherein the detection system is configured to estimate or calculate a longitudinal zone associated with a location of the ball as it rolls down the bowling lane by calculating a speed of the ball as it passes between respective ones of the optical sensors and contact sensors and, based on where the ball is located, the electronic control system is configured to control the turning on and off different color lights of the lighting system in the longitudinal zone where the ball is located.

34. The bowling center according claim 30, wherein the detection system is configured to estimate or calculate a longitudinal zone associated with a location of the ball as it rolls down the bowling lane by calculating a speed of the ball as it passes between respective ones of the optical sensors and contact sensors and, based on where the ball is located, the electronic control system is configured to control the turning on the lighting system in the longitudinal zone where the ball is located and turning off the lighting system in the longitudinal zone where the ball is not located.

35. The bowling center according claim 1, wherein the position of the ball is calculated by the optical sensor when the ball breaks a respective light beam such that the position of the ball is known even if the ball does not touch the side bumper.

* * * * *